US007384251B2

(12) United States Patent
Fujiki et al.

(10) Patent No.: US 7,384,251 B2
(45) Date of Patent: Jun. 10, 2008

(54) TROCHOIDAL OIL PUMP

(75) Inventors: Kenichi Fujiki, Gunma-ken (JP); Masaru Amano, Gunma-ken (JP)

(73) Assignee: Yamada Manufacturing Co., Ltd., Kiryu-shi (JP)

( * ) Notice: Subject to any disclaimer, the term of this patent is extended or adjusted under 35 U.S.C. 154(b) by 698 days.

(21) Appl. No.: 10/891,119

(22) Filed: Jul. 15, 2004

(65) Prior Publication Data

US 2005/0047939 A1 Mar. 3, 2005

(30) Foreign Application Priority Data

Jul. 17, 2003 (JP) ..... P2003-276354
Jun. 17, 2004 (JP) ..... P2004-180334

(51) Int. Cl.
*F01C 1/02* (2006.01)

(52) U.S. Cl. ..... 418/61.3

(58) Field of Classification Search ..... 418/61.3, 418/75, 78, 171, 190, 204, 206.5
See application file for complete search history.

(56) References Cited

U.S. PATENT DOCUMENTS 3,034,448 A 5/1962 Brundage
4,155,686 A * 5/1979 Eisenmann et al. ..... 418/170
4,398,874 A 8/1983 Eisenmann
4,813,853 A 3/1989 Otto et al.
4,859,160 A * 8/1989 White, Jr. ..... 418/61.3
5,114,325 A * 5/1992 Morita ..... 418/171
5,215,453 A * 6/1993 Petersen et al. ..... 418/61.3
5,454,702 A * 10/1995 Weidhass ..... 418/206.5
5,772,419 A * 6/1998 Hansen et al. ..... 418/61.3
6,244,843 B1 * 6/2001 Kosuge ..... 418/150
6,890,164 B2 * 5/2005 Ogata et al. ..... 418/150
7,226,279 B2 * 6/2007 Andoskin et al. ..... 418/48
2004/0191101 A1 * 9/2004 Ogata et al. ..... 418/171
2005/0180873 A1 * 8/2005 Hansen et al. ..... 418/61.3

(Continued)

FOREIGN PATENT DOCUMENTS

DE 445 893 6/1927

(Continued)

*Primary Examiner*—Thomas Denion
*Assistant Examiner*—Douglas J. Duff
(74) *Attorney, Agent, or Firm*—McGinn IP Law Group, PLLC

(57) ABSTRACT

A trochoidal oil pump which makes it possible to achieve an improved reduction in discharge pulsation and noise, and which makes it possible to realize such a reduction using an extremely simple structure. The trochoidal oil pump of the present invention comprises a rotor chamber 1 which has an intake port 2 and discharge port 3, an outer rotor 6 and an inner rotor 5. A plurality of inter-tooth spaces S, S, . . . that are formed by the tooth shapes 5*a* and 6*a* of the inner rotor 5 and outer rotor 6 comprise a maximum sealed space $S_{max}$ that is positioned in the region of the partition part 4 between the intake port 2 and discharge port 3, a plurality of inter-tooth spaces S, S, . . . within the region of the intake port 2, and a plurality of inter-tooth spaces S, S, . . . within the region of the discharge port 3. The plurality of inter-tooth spaces S, S, . . . in the intake port 2 and discharge port 3 respectively communicate with each other

17 Claims, 27 Drawing Sheets

U.S. PATENT DOCUMENTS

| | | | | |
|---|---|---|---|---|
| 2006/0140809 | A1* | 6/2006 | Enzaka et al. | 418/61.3 |
| 2006/0171834 | A1* | 8/2006 | Ogata et al. | 418/61.3 |

FOREIGN PATENT DOCUMENTS

| | | | |
|---|---|---|---|
| DE | 3134668 | A1 | 3/1983 |
| EP | 1 016 784 | A1 | 7/2000 |
| JP | 61-4882 | | 1/1986 |
| JP | 63-47914 | | 9/1988 |
| JP | 5-1397 | | 1/1993 |
| JP | 5-256268 | | 10/1993 |

* cited by examiner

TROCHOIDAL OIL PUMP

BACKGROUND OF THE INVENTION

1. Field of the Invention

The present invention relates to a trochoidal oil pump which makes it possible to improve the reduction of discharge vibration and noise, and which makes it possible to realize this improvement by means of an extremely simple structure.

2. Description of the Related Art

A pump with a construction in which the addendum part and deddendum part of the inner rotor are formed by circular arcs, the addendum part and deddendum part of the outer rotor are formed by circular arcs that correspond to the circular arc tooth shape of said inner rotor, and the deddendum part of the outer rotor is formed with dimensions that are the same as or greater than the dimensions of the addendum part of said outer rotor, so that the space between the inner rotor and outer rotor is divided into only two spaces, i.e., a space that communicates with the intake port and a space that communicates with the discharge port, is disclosed in Japanese Patent Publication No. 63-47914.

Furthermore, a pump in which circular arc parts are formed in the centers of the top parts of the outward-facing engaging teeth of the drive gear, and rectilinear parts are formed which directly connect the end parts of these circular arc parts and the points of initiation of engagement, so that a large clearance is ensured between the top parts of the inward-facing engaging teeth and the top parts of the outward-facing engaging teeth is ensured in areas other than the area where sealing is require, is disclosed in Japanese Patent Publication No. 5-1397.

In Japanese Patent Publication No. 63-47914, since the tooth shapes of the inner rotor and outer rotor are formed by a combination of simple circular arcs, adjacent volume spaces (cells) between the inner rotor and outer rotor communicate with each other in regions other than the positions of the engagement maximum part and engagement minimum part. Consequently, when the volume space between the rotors in the partition part is at a maximum, this volume space communicates with the intake port in a state in which the volume space is not closed off; accordingly, the back flow of the fluid inside the volume space to the intake port cannot be prevented, so that it is difficult to increase the pump efficiency.

Next, in Japanese Patent Publication No. 5-1397, since sealing parts (P1) that contact the inward-facing engaging teeth of the driven gear, and non-contact rectilinear parts (30*b*, 30*c*), are formed in locations on the top parts of the outward-facing engaging teeth of the drive gear, it is actually extremely difficult to ensure a sufficient size of the sealing parts and size of the rectilinear parts in the limited range of these top parts; as a result, the rectilinear parts have an extremely limited small range.

This means that the sealing parts, rectilinear parts and engaging parts are formed in tooth surfaces comprising trochoidal curves, i.e., in tooth surfaces comprising a limited tooth shape silhouette, so that the portions that remain after the sealing parts and engaging parts that are required from the standpoint of function are ensured are formed as the rectilinear parts. Accordingly, the shape range of the rectilinear parts is small, and these parts are merely formed as a structure that eliminates contact of the respective top parts in the range where such contact is not required in the engagement of the drive gear and driven gear. These rectilinear parts are formed on the tooth surfaces of the respective top parts of the outward-facing engaging teeth, and the range of these parts is also small; accordingly, slight gaps are formed which constitute non-contact parts in the engagement of the drive gear and driven gear.

The formation of communicating passages that communicate between the adjacent volume spaces that are formed between the drive gear and driven gear by the rectilinear parts formed on the outward-facing engaging teeth is limited to an extremely small range; in actuality, therefore, the non-contact parts have an extremely small range, and it is difficult to vary the size range of these communicating passages or to ensure a sufficiently large size. Consequently, it is difficult to prevent the generation of noise.

Consequently, in cases where non-contact parts are formed on the outward-facing engaging teeth, if a sufficiently large size is ensured for the engaging parts, the non-contact parts have an extremely small range, so that it is difficult to cause these parts to play the role of communicating passages. Conversely, if the size of the non-contact parts is increased in an attempt to ensure communicating passages, the engaging parts are not sufficiently ensured, so that it becomes difficult to stabilize the rotational driving of the rotors. Thus, it is extremely difficult to simultaneously satisfy the requirements for both communicating passages and engagement, and the communicating passages can be installed in only an extremely limited range. Accordingly, even if the engaging parts are ensured, the communicating passages are narrow and the flow rate is small, so that it is difficult to suppress pump noise to a low level, and to reduce discharge pulsation. The task (technical task, object or the like) that the present invention attempts to accomplish is to improve the reduction of discharge pulsation and noise in a trochoidal oil pump, and the form an extremely simple structure.

SUMMARY OF THE INVENTION

Accordingly, as a result of diligent research conducted by the present inventor in order to solve the problems, the present invention is constructed as a trochoidal oil pump comprising a rotor chamber which has an intake port and a discharge port, an outer rotor and an inner rotor, in which the plurality of inter-tooth spaces formed by the tooth shapes of the inner rotor and outer rotor comprise a maximum sealed space that is positioned in the region of a partition part between the intake port and discharge port, a plurality of inter-tooth spaces within the region of the intake port, and a plurality of inter-tooth spaces within the region of the discharge port, and the plurality of inter-tooth spaces in the intake port and discharge port respectively communicate with each other.

Furthermore, the problems are solved by constructing a trochoidal oil pump comprising an outer rotor and an inner rotor, in which the tooth shape of the inner rotor is formed according to a trochoidal curve, a top part contact region and a root part contact region which make contact in the engagement with the tooth shape of the inner rotor are formed in the tooth top part and tooth root part of the tooth shape of the outer rotor, and a non-contact region which is always in a state of non-contact with the tooth shape of the inner rotor is formed on the side edge of the tooth shape between the top part contact region and root part contact region of the tooth shape.

Furthermore, the abovementioned problems are solved by constructing a trochoidal oil pump in which the number of teeth of the inner rotor is set at 6 or greater, and the maximum sealed space formed by the outer rotor and inner rotor is formed in the partition part between the intake port and the discharge port, or by constructing a trochoidal oil pump in which the shape of the outer peripheral edge in the non-contact region of the tooth shape is a curved shape.

Furthermore, the abovementioned problems are solved by construction a trochoidal oil pump in which the formation positions of the trailing edge part of the intake port and the leading edge part of the discharge port inside the rotor chamber are located with respect to the left-right symmetry line of the rotor chamber so that the trailing edge part of the intake port is formed in the vicinity of the left-right symmetry line, and so that the leading edge part of the discharge port is formed in a position that is separated from the left-right symmetry line, and the maximum sealed space that is formed by the outer rotor and inner rotor is formed in the partition part between the trailing edge part of the intake port and the leading edge part of the discharge port.

Furthermore, the abovementioned problems are solved by constructing a trochoidal oil pump in which a recessed part is formed in the abovementioned construction in at least one of the non-contact regions formed on both side surfaces of the tooth shape in the lateral direction, so that this recessed part is recessed toward the inside of the tooth shape. Furthermore, the abovementioned problems are solved by constructing a trochoidal oil pump in which the recessed part is formed only in the rear side of the tooth shape with respect to the direction of rotation, or in which the recessed parts are formed in both side surfaces of the tooth shape in the lateral direction, in the abovementioned construction.

Next, the abovementioned problems are solved by constructing a trochoidal oil pump in which the recessed part is formed in a flattened arc shape facing the inside of the tooth shape, or constructing at trochoidal oil pump in which both recessed parts formed in both side surfaces of the tooth shape in the lateral direction have symmetrical shapes centered on the tooth shape, in the above-mentioned construction. Furthermore, the abovementioned problems are solved by constructing a trochoidal oil pump in which both recessed parts formed in both side surfaces of the tooth shape in the lateral direction have asymmetrical shapes with respect to the center of said tooth shape, and the recessed part on the rear side with respect to the direction of rotation is formed so that this recessed part is larger than the recessed part on the front side with respect to the direction of rotation in both side surfaces of the tooth shape in the lateral direction.

In the invention of claim 1, a reduction in discharge pulsation and a reduction in noise can be achieved since the plurality of inter-tooth spaces constructed by the outer rotor and inner rotor are placed in a state of communication in the formation regions of the intake port and discharge port. The adjacent inter-tooth spaces can ensure favorable engagement, and can stabilize the rotational driving of the rotors. Furthermore, since the fluid filling rate of the maximum sealed space can be increased, cavitation can be suppressed, and the pump efficiency can be improved. In the invention of claim 2, the pump has merits comparable to those of claim 1.

In the invention of claim 3, a favorable number of teeth can be obtained by setting the number of teeth of the inner rotor at 6 or greater; furthermore, since the tooth shape is a relatively large tooth shape in the outer rotor, non-contact regions can easily be formed. Moreover, in the invention of claim 4, the pump performance can be improved even further by forming the shape of the outer circumferential edge in the non-contact region of the tooth shape as a curved shape. Furthermore, in the invention of claim 5, a reduction in discharge pulsation and a reduction in noise can be achieved; furthermore, a drop in the discharge amount in the high-speed rotation region can be prevented, and the filling rate of the maximum sealed space can be increased. Accordingly, cavitation can be suppressed so that the pump efficiency can be improved.

In the invention of claim 6, the space of the communicating parts is increased even further, so that the amount of fluid flowing through the inter-tooth spaces is increased; accordingly, the flow rate is increased, and noise can be reduced. In the invention of claim 7, the width of the communicating parts that communicate between the inter-tooth spaces formed by the inner rotor and outer rotor on the intake port side in particular is broadened, so that the pressure balance of the fluid can be improved and the intake efficiency can be improved. In the invention of claim 8, the communicating parts between the inter-tooth spaces in the intake port and discharge port are widened by the formation of the recessed parts on both side surfaces of the tooth shape in the lateral direction; accordingly, the area of the inter-tooth spaces can be increased, so that the through-flow of the fluid can be improved, and the pump efficiency can be improved.

In the invention of claim 9, the fluid flowing through the communicating parts can flow extremely smoothly as a result of the formation of the recessed parts in a flattened arc shape. Next, in the invention of claim 10, since the shapes of the recessed parts on both sides of the tooth shape of the outer rotor in the lateral direction are formed as symmetrical shapes, dimensional variation in the manufacturing process can be reduced, so that the precision of the tooth shape of the outer rotor can be improved. In the invention of claim 11, the width of the communicating parts between the inter-tooth spaces on the intake port side is broadened, so that the pressure balance of the fluid is improved. Accordingly, a reduction in discharge pulsation and a reduction in noise can be achieved; furthermore, a drop in the discharge amount in the high-speed rotation region can be prevented, cavitation can be suppressed, and erosion can be reduced.

DESCRIPTION OF THE PREFERRED EMBODIMENTS

Figure 1A:
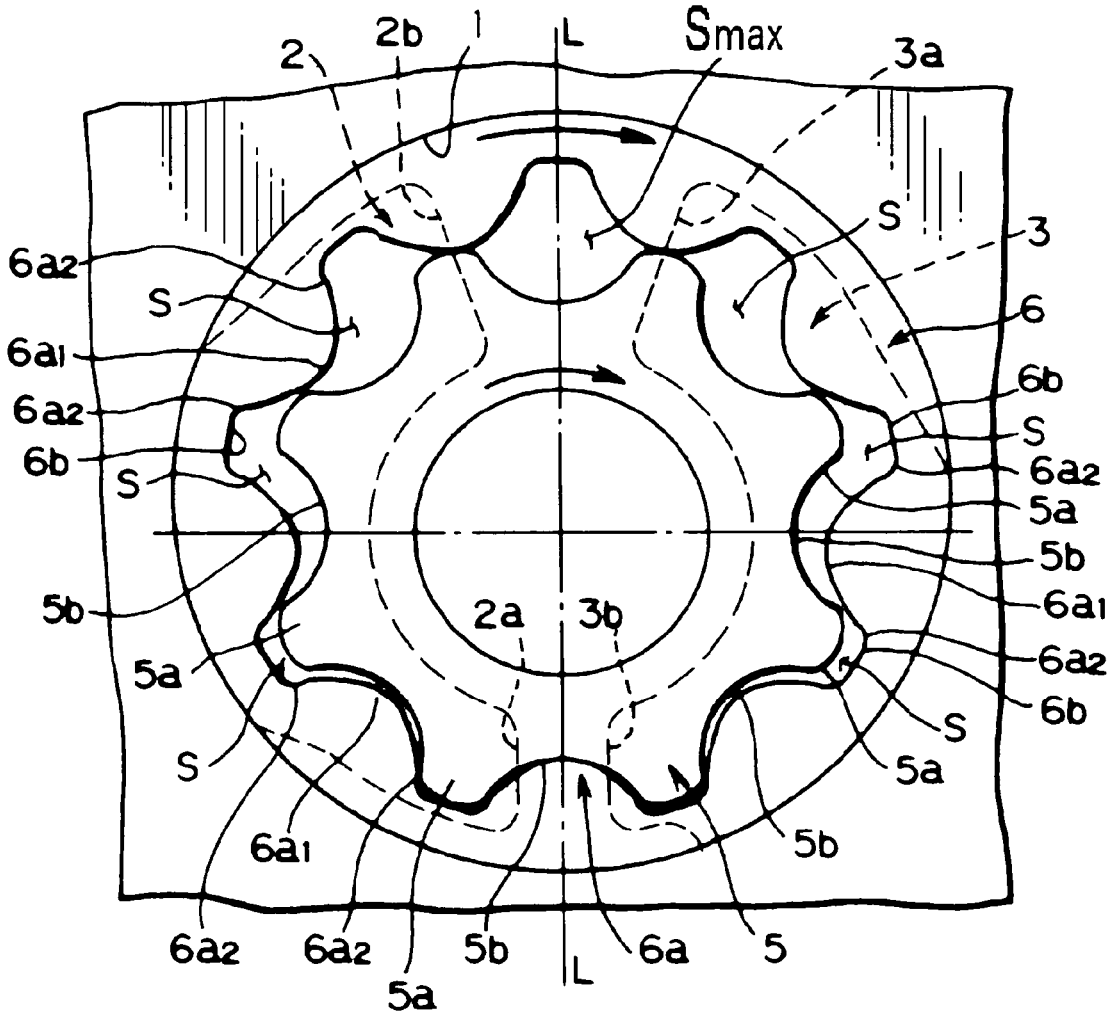
FIG. 1A is a front view showing a case in which an outer rotor in which non-contact regions of a first type are formed is provided in a first embodiment.
Figure 7A:
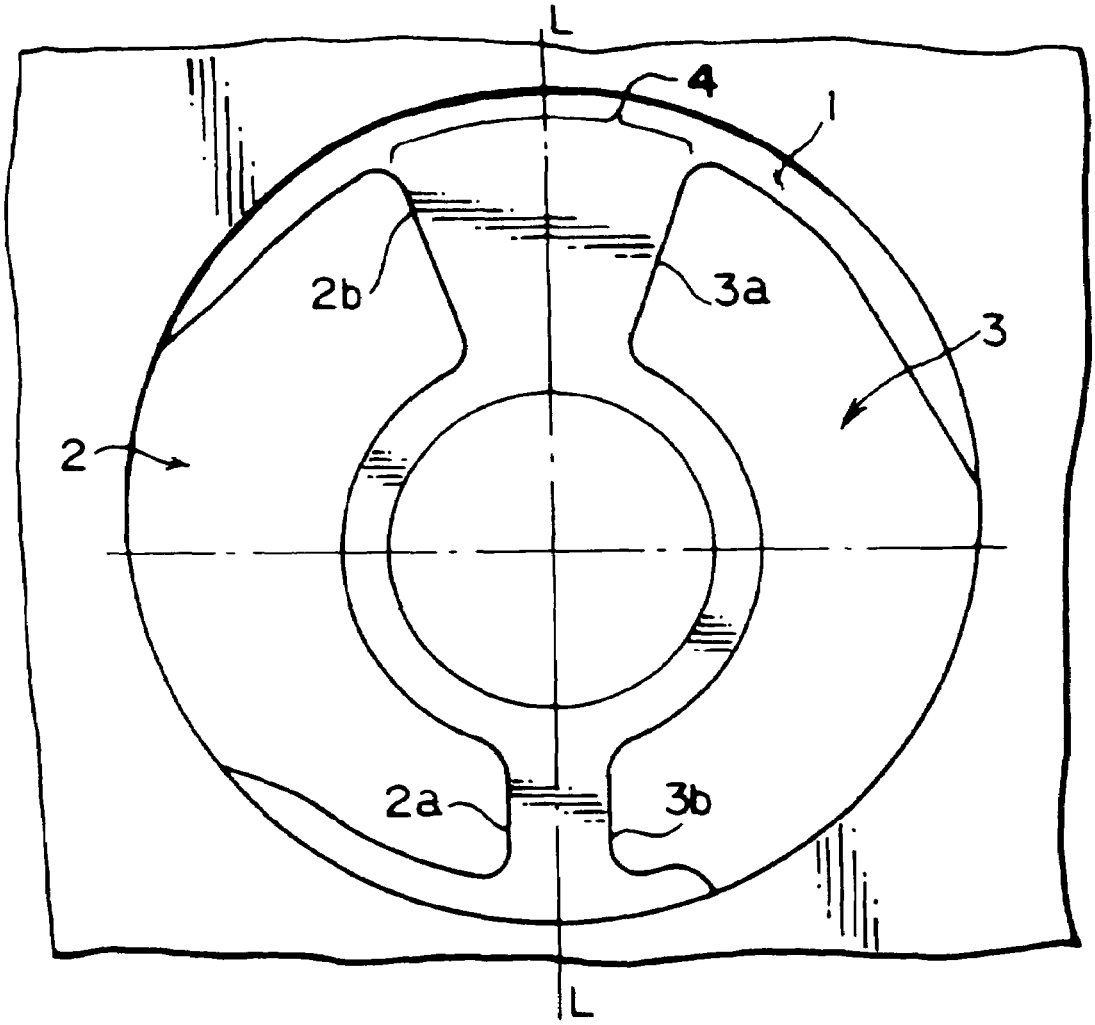
FIG. 7A is a front view of the rotor chamber in the first embodiment.

Preferred embodiments of the present invention will be described below with reference to the attached figures. As is shown in FIG. 1A, the trochoidal oil pump of the present invention is a pump in which an inner rotor 5 and outer rotor 6 with a trochoidal tooth shape are mounted in a rotor chamber 1 formed inside a pump casing. As is shown in FIG. 7A, an intake port 2 and a discharge port 3 are formed substantially on the side of the outer circumference along the circumferential direction in the rotor chamber 1. The intake port 2 and discharge port 3 are formed in positions that show left-right symmetry with respect to the center of the rotor chamber 1. In concrete terms, as is shown in FIG. 1A, FIG. 7A and the like, if a perpendicular line that passes through the center of the rotor chamber 1 with respect to the lateral direction is taken as a virtual left-right symmetry line L, then the intake port 2 is formed so that this port is disposed on the left side of the left-right symmetry line L, and the discharge port 3 is formed so that this port is positioned on the right side of the left-right symmetry line L; thus, the intake port 2 and discharge port 3 show left-right symmetry.

As is shown in FIG. 1A, a leading edge part 2*a* and a trailing edge part 2*b* are present in the intake port 2. The end part location where the inter-tooth spaces S formed by the rotation of the inner rotor 5 and outer rotor 6 move and first reach the intake port 2 is the leading edge part 2*a*, and the end part location where the inter-tooth spaces S leave the intake port 2 as a result of rotation is the trailing edge part 2*b*. Similarly, a leading edge part 3*a* and trailing edge part 3*b* are also present in the discharge port 3. The end part location where the inter-tooth spaces S formed by the rotation of the inner rotor 5 and outer rotor 6 move and first reach the discharge port 3 is the leading edge part 3*a*, and the end part location where the inter-tooth spaces S leave the discharge port 3 as a result of rotation is the trailing edge part 3*b*. Here, furthermore, it is assumed that the direction of rotation of the inner rotor 5 and outer rotor 6 is the clockwise direction. Furthermore, in cases where the formation positions of the intake port 2 and discharge port 3 are reversed in the left-right direction, the direction of rotation of the inner rotor 5 and outer rotor 6 is the counterclockwise direction.

The number of teeth of the inner rotor 5 is at least one less than the number of teeth of the outer rotor 6, thus creating a relationship which is such that when the inner rotor 5 completes one revolution, the outer rotor 6 rotates with a delay of one tooth. Thus, the inner rotor 5 has tooth shapes 5*a* that protrude outward, and tooth bottom parts 5*b* that are recessed inward; similarly, the outer rotor 6 has tooth shapes 6*a* that protrude toward the center (of rotation) from the inner circumferential side, and tooth bottom parts 6*b* that are recessed. Furthermore, as is shown in FIG. 1A, the inner rotor 5 and outer rotor 6 are constantly engaged at one place, so that the tooth shapes 5*a* of the inner rotor 5 enter the tooth bottom parts 6*b* of the outer rotor 6, and so that the tooth shapes 6*a* of the outer rotor 6 enter the tooth bottom parts 5*b* of the inner rotor 5. In this case, a structure may be formed in which the tooth top parts $\mathbf{6}a_1$ of the tooth shapes 6*a* contact the tooth bottom parts 5*b* of the inner rotor 5, or a structure may be formed in which the tooth top parts $\mathbf{6}a_1$ of the tooth shapes 6*a* do not contact the tooth bottom parts 5*b* of the inner rotor 5.

Figure 1B:
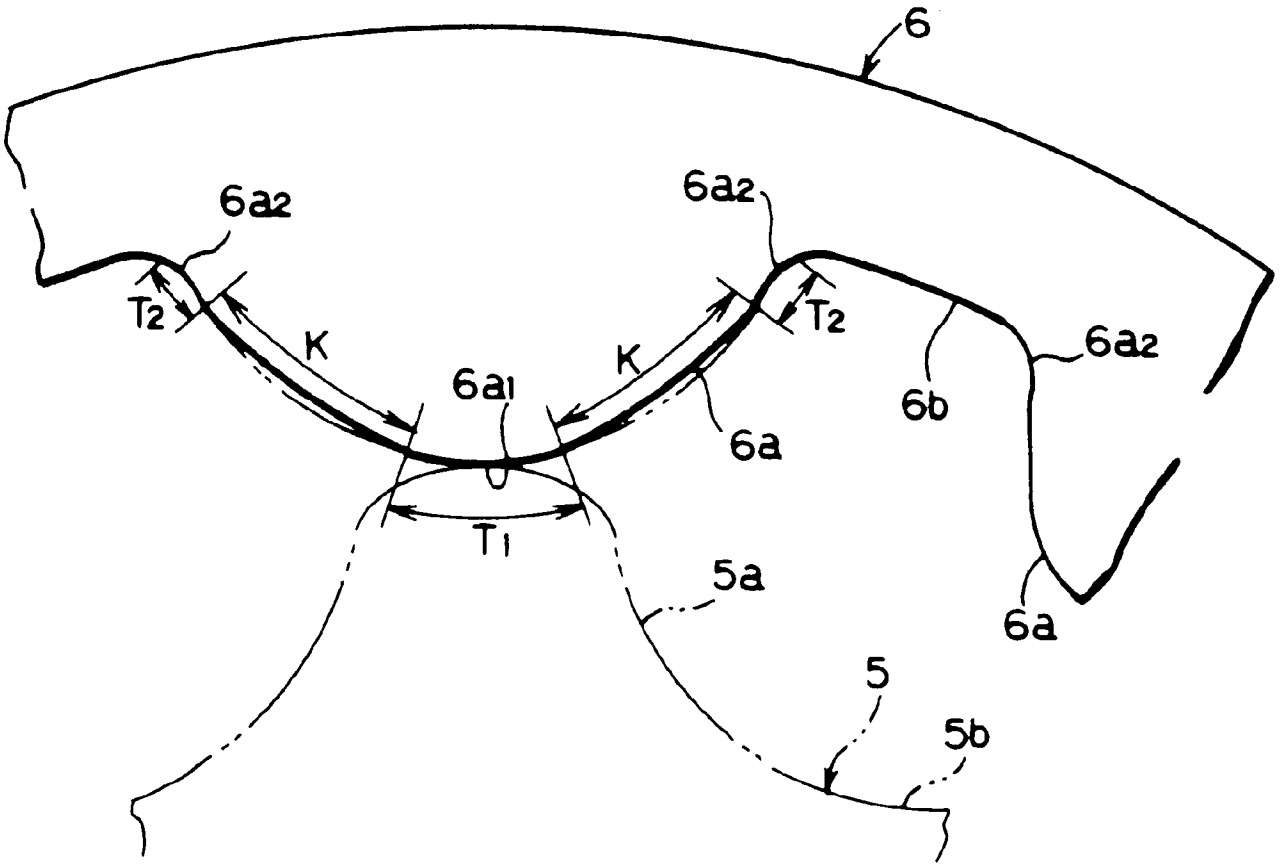
FIG. 1B is an enlarged view of the essential parts in FIG. 1A.
Figure 3A:
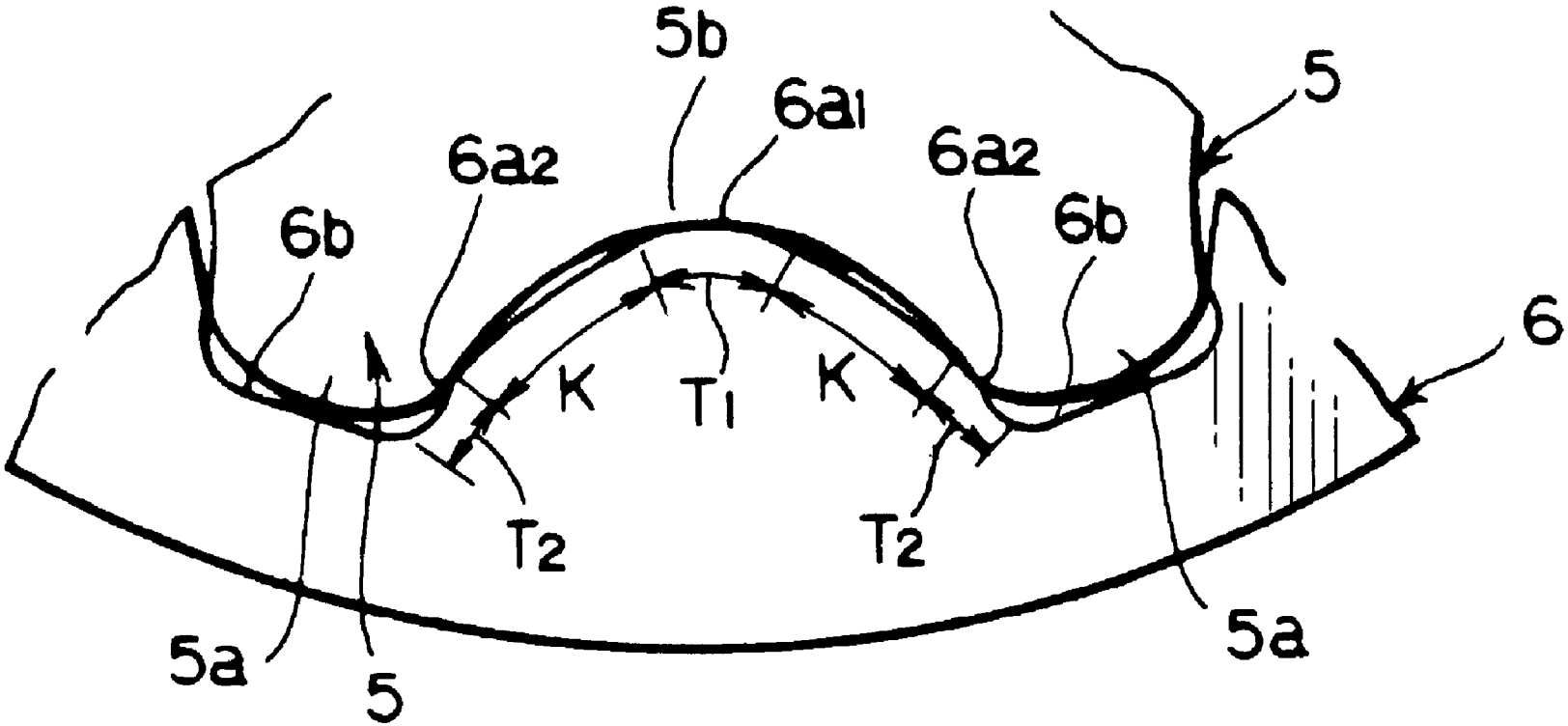
FIG. 3A is an enlarged view of a state in which the tooth bottom parts of an inner rotor and the tooth shaped parts of an outer rotor in which non-contact regions of a first type are formed are engaged.
Figure 3B:
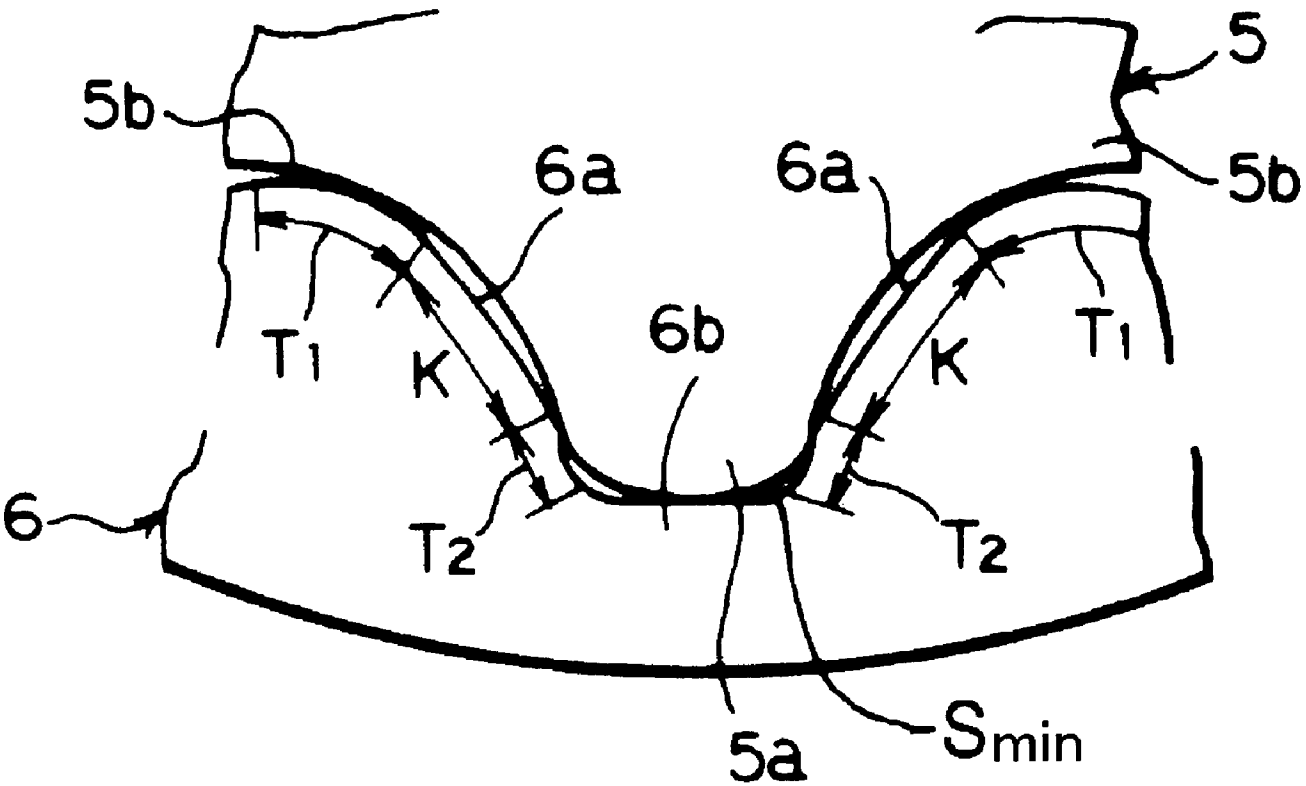
FIG. 3B is an enlarged view of a state in which the tooth shaped parts of an inner rotor and the tooth bottom parts of an outer rotor in which non-contact regions of a first type are formed are engaged.

First, in the outer rotor 6 as shown in FIGS. 3(A) and 3(B), top part contact regions $T_1$ are set on the tooth top parts $\mathbf{6}a_1$, and root part contact regions $T_2$ are set on the tooth root parts $6a_2$, as contact tooth surfaces that engage with the inner rotor 5. Furthermore, non-contact regions K that are always in a state of non-contact with the tooth shapes 5*a* of the inner rotor 5 are formed between the tooth top parts $6a_1$ and the tooth root parts $6a_2$. The non-contact regions K are regions that are always in a state of non-contact with the tooth shapes 5*a* and tooth bottom parts 5*b* when the outer rotor 6 is engaged with the inner rotor 5. As is shown in FIG. 1B, the tooth top parts $6a_1$ are the tip end portions of the tooth shapes 6*a*; furthermore, the tooth root parts $6a_2$ are the root portions of the tooth shapes 6*a*, and are regions with an appropriate range positioned toward the tooth bottom parts 6*b* on the side surfaces of the tooth shapes 6*a*.

Furthermore, the non-contact regions K of the tooth shapes 6*a* comprise a plurality of different types of regions. As non-contact regions K of the first type, the silhouettes of the tooth shapes 6*a* are formed further to the inside than the outer circumferential edges of the outer rotor tooth shapes in a case where silhouettes comprising the circular arcs that form the teeth of the ordinary outer rotor 6 or generating curves based on the inner rotor (i.e., the portions indicated by a two-dot chain line in the tooth shapes 6*a* shown in FIG. 1B) are taken as the outer circumferential edges of the tooth shapes of the outer rotor. Specifically, the tooth side surface silhouette shapes of these non-contact regions K are formed as curves that differ from the silhouette in cases where the outer rotor 6 is formed by ordinary circular arcs or generating curves based on the inner rotor 5. These non-contact regions K are set in locations on both side surfaces in the lateral direction of the tooth shapes 6*a* of the outer rotor 6. Here, furthermore, the lateral direction of the tooth shapes 6*a* refers to the direction that is indicated along the direction of rotation of the outer rotor 6.

The curved shapes in these non-contact regions K may be set as free curves that combine circular arcs and arbitrary curves, or as curves that are expressed by algebraic equations (algebraic curves) or the like. Furthermore, these curved shapes may also be composite curves that are obtained by combining different curves of the abovementioned types. Furthermore, the circular arcs used may also be infinitely large circular arcs. If these curves are expressed by algebraic equations, it is desirable that the order of the equations be 2 to 5. The non-contact regions K of the outer rotor 6 are regions that are formed by the curves that differ from ordinary circular arcs or generating curves based on the inner rotor 5. The tooth shapes 5*a* of the inner rotor 5 that engages with the outer rotor 6, which comprise ordinary trochoidal curves, form a silhouette that maintains a non-contact state when both rotors are in an engaged state.

Furthermore, in the tooth top parts $6a_1$ and tooth root parts $6a_2$, regions that contact the tooth shapes 5*a* of the inner rotor 5 are formed. In concrete terms, the tooth top parts $6a_1$ have top part contact regions $T_1$, and constitute parts that contact the tooth shapes 5*a* of the inner rotor 5. The tooth root parts $6a_2$ also constitute parts that contact with the tooth shapes 5*a* of the inner rotor 5. Furthermore, the top part contact regions $T_1$ and root part contact regions $T_2$ of the tooth shapes 6*a* are not necessarily regions that constantly and simultaneously contact the tooth shapes 5*a*, but are rather regions which are such that either the top part contact regions $T_1$ or the root part contact regions $T_2$ contact the tooth shapes 5*a*. In particular, the top part contact regions $T_1$ and root part contact regions $T_2$ are regions where the tooth shapes 6*a* of the outer rotor 6 contact the tooth shapes 5*a* of the inner rotor 5 and receive the rotational force from the tooth shapes 5*a* when the inner rotor 5 is caused to rotate by the driving source, and this rotation is transmitted to the outer rotor 6.

Thus, non-contact regions K that do not contact the inner rotor 5 are formed on the tooth surfaces of the tooth shapes 6*a* of the outer rotor 6, and the inner rotor 5 is formed with tooth shapes 5*a* that comprise ordinary trochoidal curves; in particular, furthermore, regions that correspond to the non-contact regions K are not formed on the side of the inner rotor 5. Furthermore, as a result of the outer rotor 6 and inner rotor 5 being mounted in combination in the pump chamber of the oil pump, only the tooth top parts $6a_1$ and tooth root parts $6a_2$ of the outer rotor 6 contact the outer circumferential edges of the tooth shapes 5*a* of the inner rotor 5 formed by trochoidal curves while the inner rotor 5 is rotationally driven and the tooth shapes 5*a* of the inner rotor 5 and the tooth shapes 6*a* of the outer rotor 6 are caused to engage.

Figure 4:
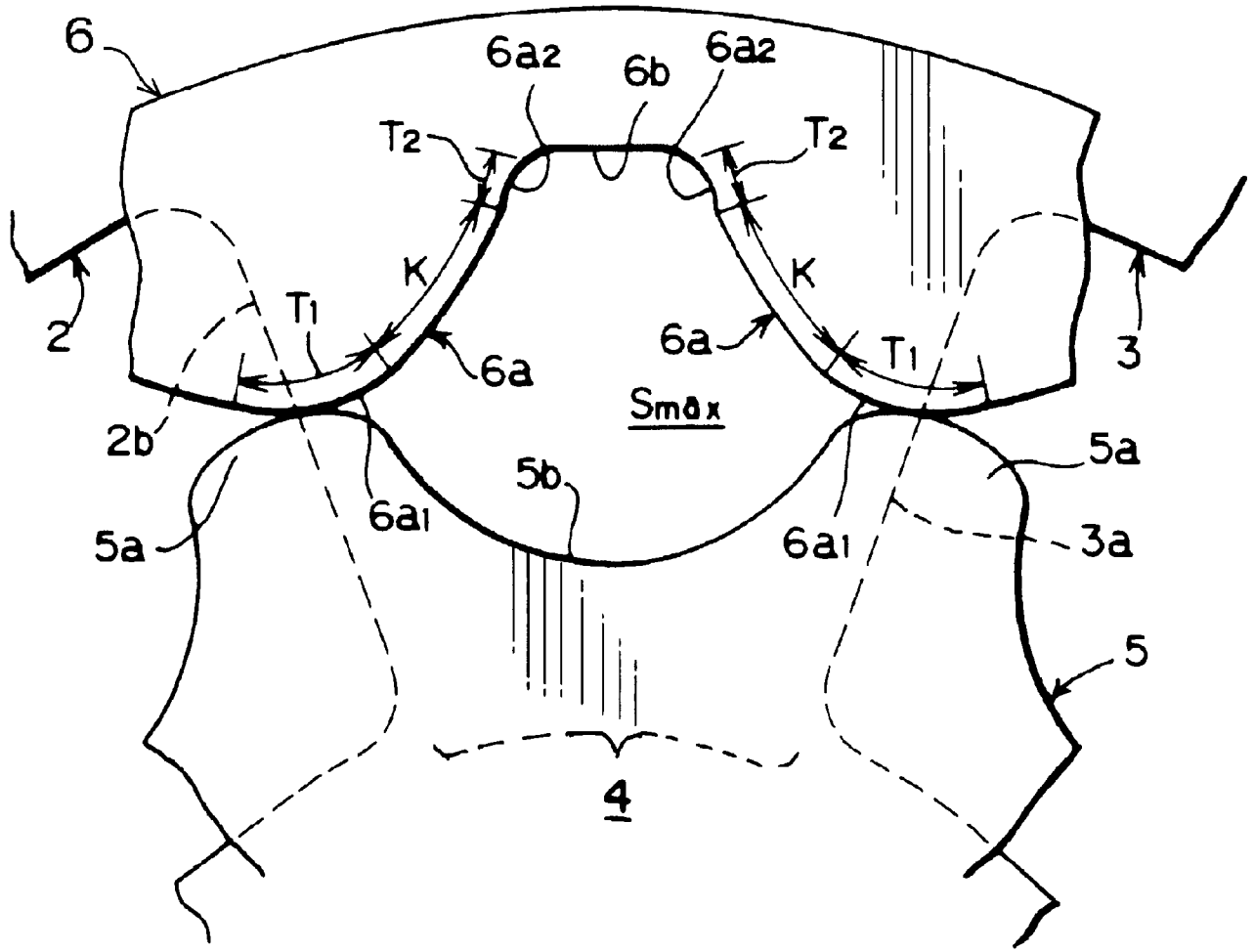
FIG. 4 is an enlarged front view of the location of the maximum sealed space constructed by the inner rotor and the outer rotor in which non-contact regions of the first type are formed.

Furthermore, the inter-tooth spaces S, S, . . . that are constructed by the tooth shapes 5*a* and tooth bottom parts 5*b* of the inner rotor 5 and the tooth shapes 6*a* and tooth bottom parts 6*b* of the outer rotor 6 are maintained in a state of communication by the gap parts created by the non-contact regions K in the intake port 2 and discharge port 3 of the pump housing; moreover, a maximum sealed space $S_{max}$ (see FIG. 1A, FIG. 4 and the like) and a minimum sealed space $S_{min}$ (see FIG. 3B) that consist of the outer rotor 6 and inner rotor 5 are formed in a partition part 4 that is disposed between the intake port 2 and discharge port 3.

Figures 2A, 2B:
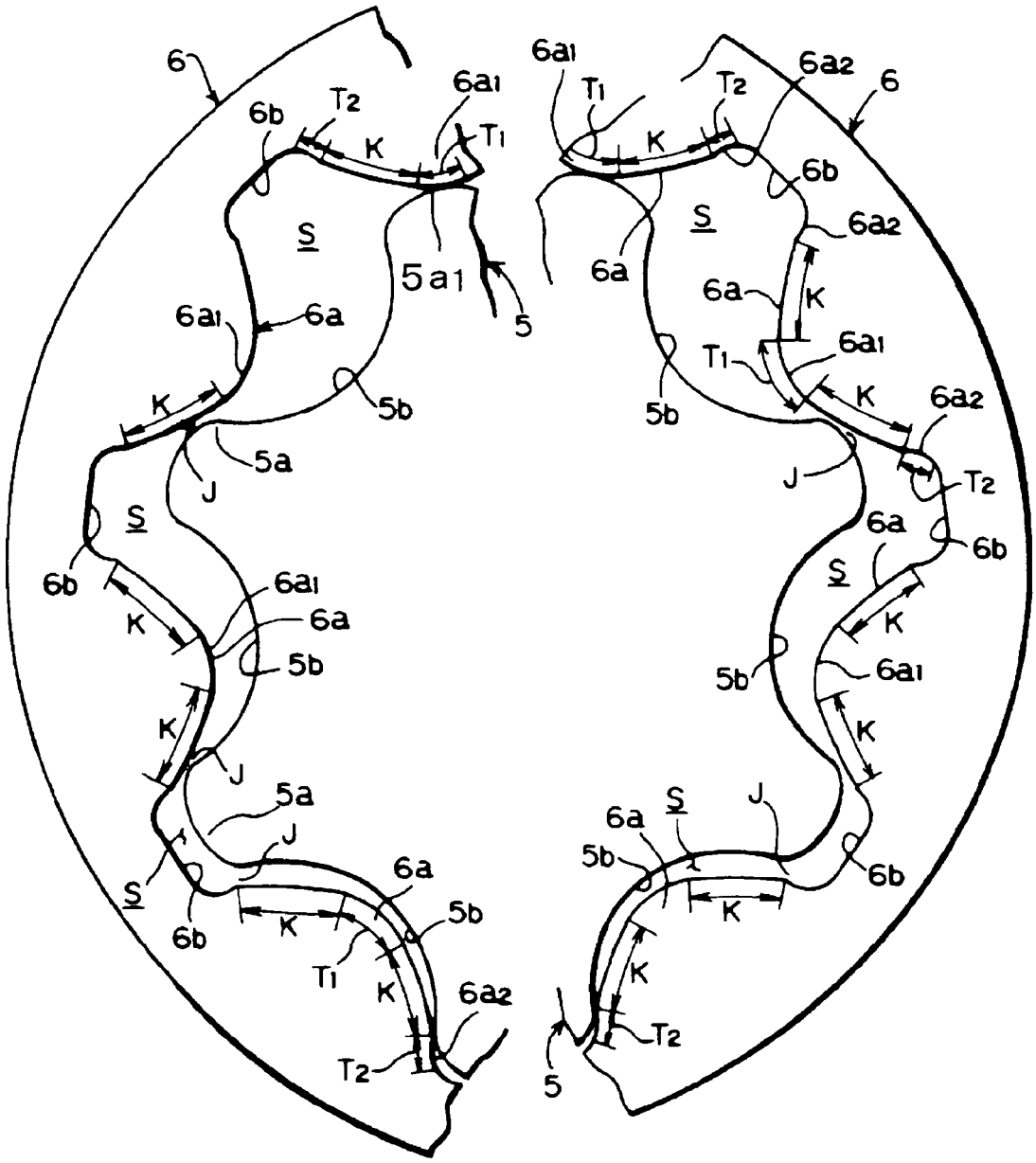
FIG. 2A is an enlarged view of a state in which a plurality of inter-tooth spaces on the intake port side communicate with each other.
FIG. 2B is an enlarged view of a state in which a plurality of inter-tooth spaces on the discharge port side communicate with each other.

As is shown in FIG. 2A, the plurality of inter-tooth spaces S, S, . . . between the rotors which are formed by the outer rotor 6 and inner rotor 5 in the intake port 2 are maintained in one to two communicating states by the non-contact regions K of the outer rotor 6. Similarly, in the case of the plurality of inter-tooth spaces S, S, . . . between the rotors which are formed by the outer rotor 6 and inner rotor 5 in the discharge port 3, as is shown in FIG. 2B, a state is produced in which one to two communicating parts J, J, . . . are formed by the non-contact regions K of the outer rotor 6. Furthermore, in regard to the engagement between the engaging regions of the tooth top parts $6a_1$ of the outer rotor 6 and the tooth top parts $5a_1$ of the inner rotor 5, the tip clearance that is set between the rotors of an ordinary trochoidal pump is provided.

In order to form a state of communication by means of the non-contact regions K of the outer rotor 6 in the intake port 2 and discharge port 3, it is desirable that the number of teeth of the inner rotor be set at 6 or greater. The maximum sealed space $S_{max}$ is a sealed inter-tooth space S that is formed by the partition part 4 between the intake port 2 and discharge port 3. Furthermore, the volume of the maximum sealed space $S_{max}$ varies according to the formation positions of the trailing edge part 2*b* of the intake port 2 and the leading edge part 3*a* of the discharge port 3. The two cases described below are included in the maximum sealed space $S_{max}$. One case is a case in which the volume of the inter-tooth space S reaches a maximum as shown in FIG. 1A as a result of the location of the partition part 4 positioned between the trailing edge part 2*b* of the intake port 2 and the leading edge part 3*a* of the discharge port 3, and the sealed space that is thus constructed is taken as the maximum sealed space $S_{max}$. The other case is a case in which an inter-tooth space S in an unsealed state which has a maximum volume and which communicates with the intake port 2 moves toward the discharge port 3, and the inter-tooth space S with a reduced volume is partitioned by the partition part 4 positioned between the intake port 2 and discharge port 3, so that a maximum sealed space $S_{max}$ is constructed, as will be seen in a second embodiment of the present invention described later (see FIGS. 5 and 6).

The inter-tooth spaces S, S, . . . that are constructed by the outer rotor 6 and inner rotor 5 positioned in the respective formation regions of the intake port 2 and discharge port 3 are divided so that at least three compartments are formed. One of the inter-tooth spaces S among this plurality of inter-tooth spaces S, S, . . . , which is positioned inside the partition part 4 between the intake port 2 and discharge port 3, constitutes the maximum sealed space $S_{max}$ (see FIG. 1A and FIG. 4). Furthermore, the inter-tooth spaces S in the intake port 2 are disposed in a communicating state by means of the communicating parts J created by the non-contact regions K; similarly, the inter-tooth spaces in the discharge port 3 are disposed in a communicating state by means of the communicating parts J created by the non-contact regions K (see FIGS. 2(A) and 2(B)).

In the prior art (see FIGS. 1 and 2 of Japanese Patent Publication No. 63-47914 and FIGS. 3 and 4 of Japanese Patent Publication No. 5-1397), inter-tooth spaces between the rotors communicate between the intake port side and discharge port side and are divided into only two spaces by small limited contact regions between the tooth top parts of the inner rotor and the tooth top parts of the outer rotor, so that in the case of maximum volume between the intake port and discharge port, there is no partitioning from the intake port or discharge port, but rather a state of communication with the inter-tooth spaces of one of these ports. Specifically, the inter-tooth spaces of the intake port and discharge port are caused to communicate and are divided into only two spaces, so that a maximum sealed space cannot be formed between the intake port and discharge port.

In the present invention, on the other hand, non-contact regions K are formed in the tooth shapes 6*a* of the outer rotor 6, and formed parts that are used to constitute the non-contact regions K are not formed in the tooth shapes 5*a* of the inner rotor 5. Specifically, in cases where the tooth shapes 5*a* of the inner rotor 5 are formed as ordinary trochoidal curves, the plurality of inter-tooth spaces S, S, . . . that are formed by the intake port 2 and discharge port 3 are placed in a communicating state by the communicating parts J, J, . . . that are created by the non-contact regions K, and a maximum sealed space $S_{max}$ can be disposed in the partition part 4 between the intake port 2 and discharge port 3.

As result, the pump efficiency can be increased, and the special effect of a reduction in pulsation can be manifested. Furthermore, the tooth shapes 6*a* of the outer rotor of the present invention ensure a communicating state between the inter-tooth spaces S, S, . . . by means of the non-contact regions K, and the maximum sealed space $S_{max}$ can be formed in accordance with the positions of the trailing edge part 2*b* of the intake port 2 and the leading edge part 3*a* of the discharge port 3 by setting the non-contact regions K, top part contact regions $T_1$ and root part contact regions $T_2$.

However, the pumps of the prior art are pumps in which non-contact parts are formed on the inner rotor, or pumps in which tooth shapes corresponding to the tooth shapes of the inner rotor (non-contact parts formed by circular arcs) are formed in the outer rotor, so that non-contact parts (communicating parts) and contact parts (non-communicating parts) are formed in an extremely limited range. Accordingly, these non-contact parts and contact parts are divided into only two spaces, so that the formation of a maximum sealed space, or the formation of such a maximum sealed space by moving the position of this space toward the discharge port side, is difficult.

In the present invention, in regard to the tooth shapes 6*a* of the outer rotor 6, the position of the maximum sealed space $S_{max}$ can also be set by variously setting the length of the range of the contact region where the tooth top parts $\mathbf{6}a_1$ contact the tooth shapes 5*a* of the inner rotor with respect to the set position of the maximum sealed space $S_{max}$, and the range length, depth and shape (tooth shape comprising a curve) of the non-contact regions K between the tooth top parts $\mathbf{6}a_1$ and tooth root parts $\mathbf{6}a_2$; furthermore, the structure of the communication in the intake port 2 and discharge port 3, and the amount of this communication, can be arbitrarily set, so that the pump performance can be improved.

As a result of the non-contact regions K being formed by means of curves between the tooth top parts $\mathbf{6}a_1$ and tooth bottom parts $\mathbf{6}a_2$ in the tooth shapes 6*a* of the outer rotor 6, the gaps (communicating parts J) used to cause communication between the inter-tooth spaces S, S, . . . can be set at a sufficiently large size compared to a conventional trochoidal pump in which the non-contact regions K are not formed in the tooth shapes 6*a* of the outer rotor 6, so that the communication between the inter-tooth spaces S, S, . . . that are formed by the inner rotor 5 and outer rotor 6 is sufficient, thus making it possible to reduce discharge pulsation, and therefore to reduce noise.

Furthermore, as a result of the formation of the non-contact regions K in the tooth shapes 6*a* of the outer rotor 6, contact regions can be sufficiently ensured even if the non-contact regions are formed with a large size. Accordingly, not only communication between the inter-tooth spaces S, S, . . . , but also engagement, can be ensured in a favorable manner, so that the rotational driving of the rotors can be stabilized.

Since the present invention is devised so that a maximum sealed space $S_{max}$ is formed, and so that the volume spaces of the inter-tooth spaces S, S, . . . in the intake port 2 and discharge port 3 are caused to communicate by the creation of one to two communicating parts J, J, . . . by the non-contact regions K of the outer rotor 6, a reduction in discharge pulsation and a reduction in noise can be accomplished; furthermore, the filling rate of the maximum sealed space $S_{max}$ can be increased, so that cavitation can be suppressed, thus making it possible to improve the pump efficiency.

Since the inner rotor 5 is formed as a rotor with a large number of teeth, in which six or more tooth shapes 5*a*, 5*a*, . . . are formed, the size of the respective tooth shapes 5*a* is reduced; on the other hand, however, since the size of the outer rotor 6 is relatively large, the non-contact regions K can easily be formed. Furthermore, by moving the maximum sealed space $S_{max}$ to the side of the discharge port 3, and causing the volume spaces of the inter-tooth spaces S, S, . . . of the intake port 2 to communicate by means of the non-contact regions K of the tooth shapes 6*a* of the outer rotor 6, it is possible to achieve a reduction in discharge pulsation and a reduction in noise. Furthermore, a drop in the discharge amount in the high-speed rotation region can be prevented, so that the filling rate of the maximum sealed space $S_{max}$ can be increased. Accordingly, cavitation can be suppressed, and the pump efficiency can be improved.

The sizes of the top part contact regions $T_1$ of the tooth top parts $\mathbf{6}a_1$, root part contact regions $T_2$ of the tooth root parts $\mathbf{6}a_2$ and non-contact regions 14 of the tooth shapes 6*a* of the outer rotor 6 can be set in accordance with the position of the maximum sealed space $S_{max}$; furthermore, the communicating state between this maximum sealed space $S_{max}$ and the inter-tooth spaces S, S, . . . can be arbitrarily set, so that the degree of freedom in design can be increased. Consequently, various pump performance values can be set. The side of the outer rotor 6 is a place into which oil is moved by centrifugal force; this oil can be favorably circulated by the communication created by the non-contact regions K in the tooth shapes 6*a* of the outer rotor 6, so that the reduction in discharge pulsation and reduction in noise can be improved compared to the prior art.

Figure 5:
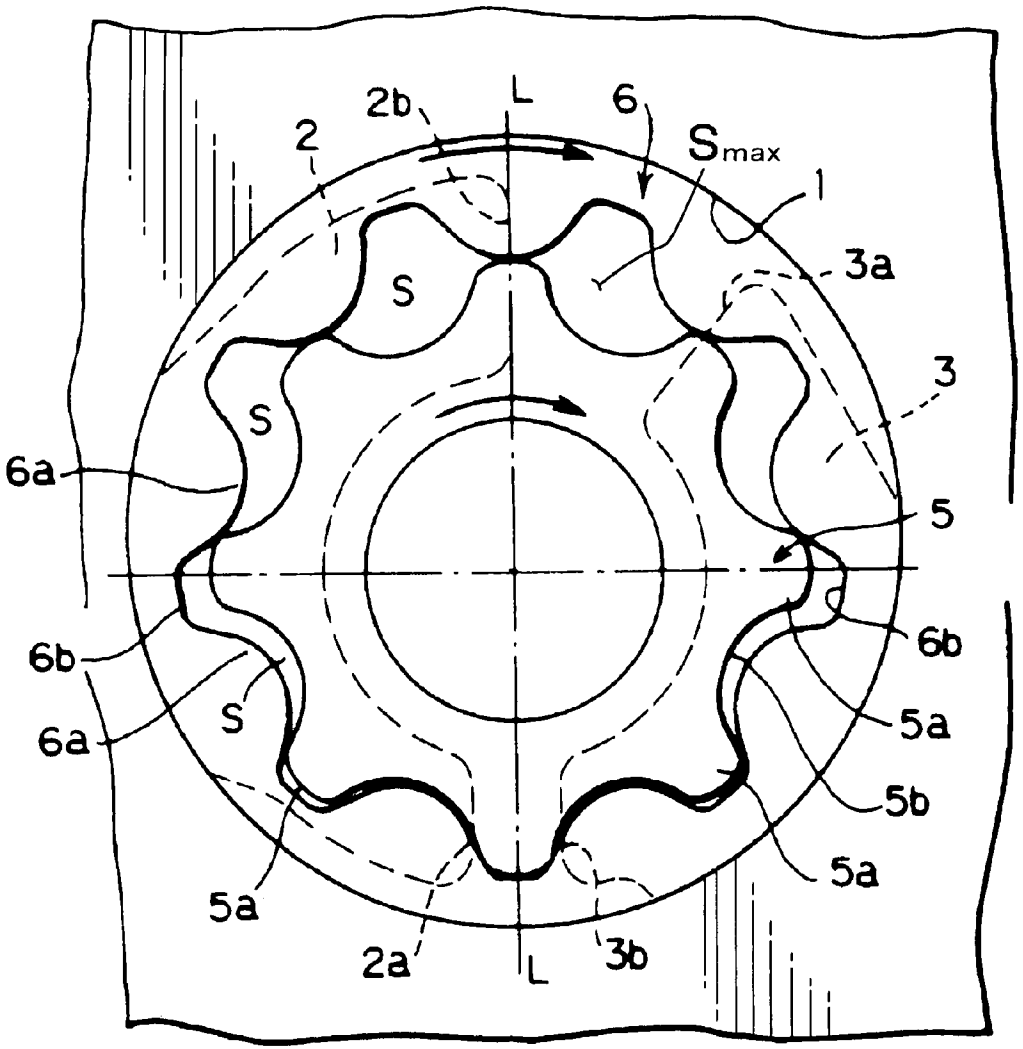
FIG. 5 is a front view showing a case in which an outer rotor in which non-contact regions of a first type are formed is provided in a second embodiment.
Figure 6:
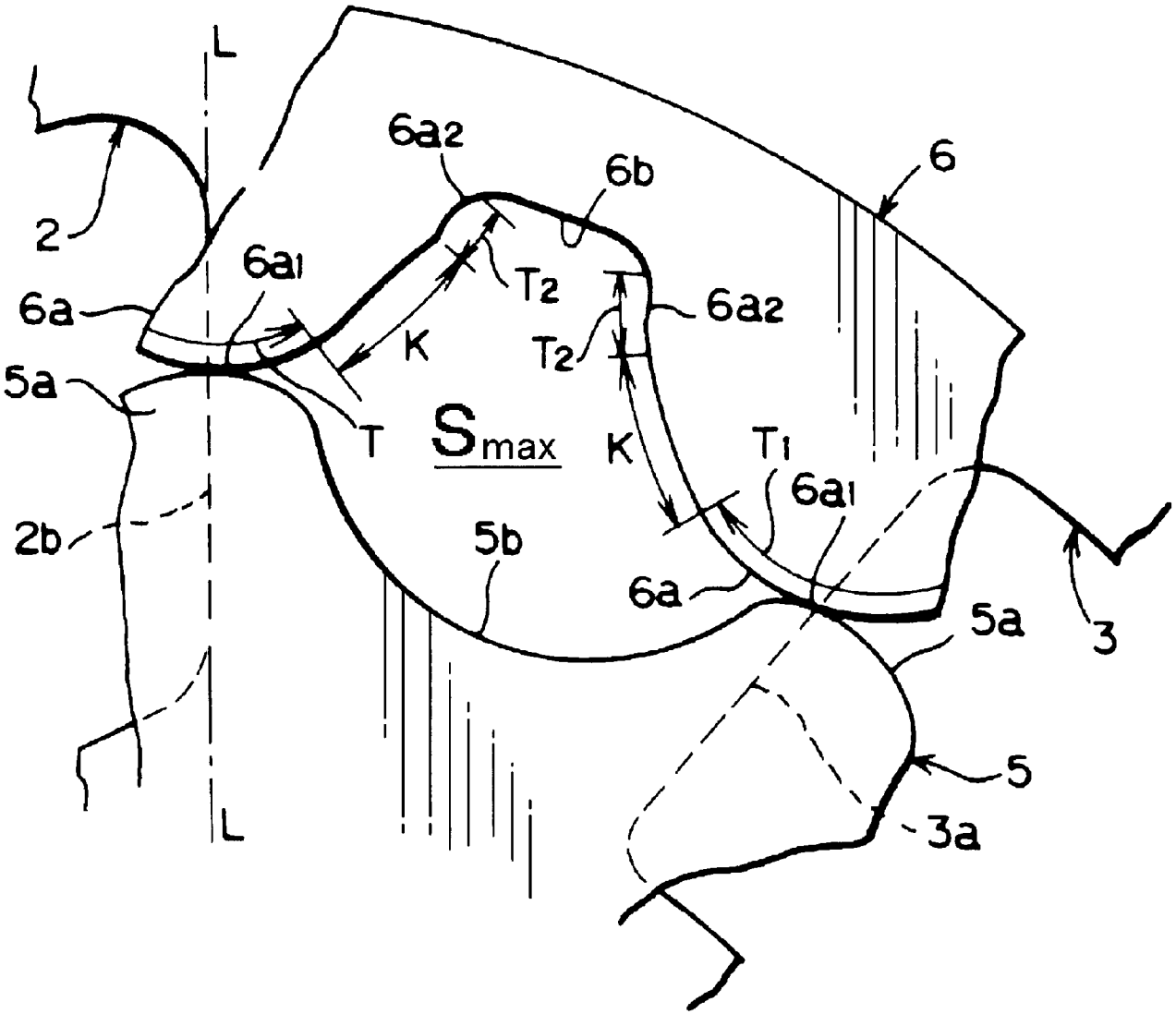
FIG. 6 is an enlarged front view of the location of the maximum sealed space in the second embodiment formed by the outer rotor in which non-contact regions of a first type are formed, and the inner rotor.
Figure 7B:
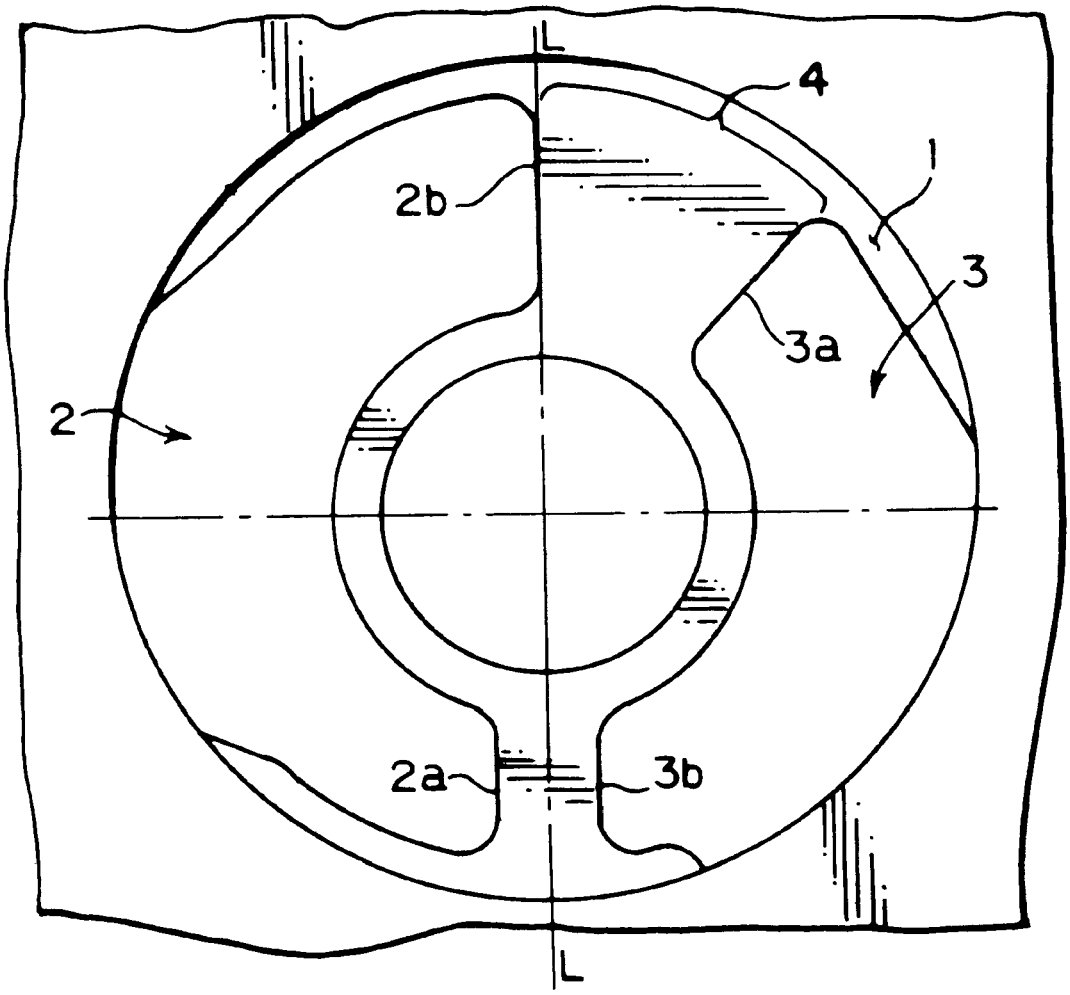
FIG. 7B is a front view of the rotor chamber in the second embodiment.

In a second embodiment of the present invention, as is shown in FIG. 5 and FIG. 7B, the formation positions of the trailing edge part 2*b* of the intake port 2 and leading edge part 3*a* of the discharge port 3 formed inside the rotor chamber 1 are set so that the trailing edge part 2*b* of the intake port 2 is formed in the vicinity of the left-right symmetry line L of the rotor chamber 1, and the leading edge part 3*a* of the discharge port 3 is formed in a position that is separated from this left-right symmetry line L. In this case, as is shown in FIG. 6, the maximum sealed space $S_{max}$ that is formed by the outer rotor 6 and inner rotor 5 is formed in the region of the partition part 4 between the trailing edge part 2*b* of the intake port 2 and the leading edge part 3*a* of the discharge port 3.

The sealed space that is thus moved toward the side of the discharge port 3 has a smaller volume when the volume is at a maximum (maximum sealed space $S_{max}$); however, since this is a maximum as a space that is completely sealed by the partition part 4, it may be said that this is also included in the concept of a maximum sealed space $S_{max}$. Specifically, the maximum sealed space $S_{max}$ is a sealed space among the inter-tooth spaces S, S, . . . that are formed by the inner rotor 5 and outer rotor 6, and is a sealed region in which the tooth shapes 5*a* and tooth shapes 6*a* do not create a communicating part J by means of the non-contact regions 14, so that only the usual tip clearance exists between the tooth top parts $\mathbf{5}a_1$ and tooth top parts $\mathbf{6}a_1$. Accordingly, the maximum sealed space $S_{max}$ does not always have the maximum volume; there may be instances in which the maximum sealed space $S_{max}$ and inter-tooth space with the maximum volume have different volumes.

Figure 8:
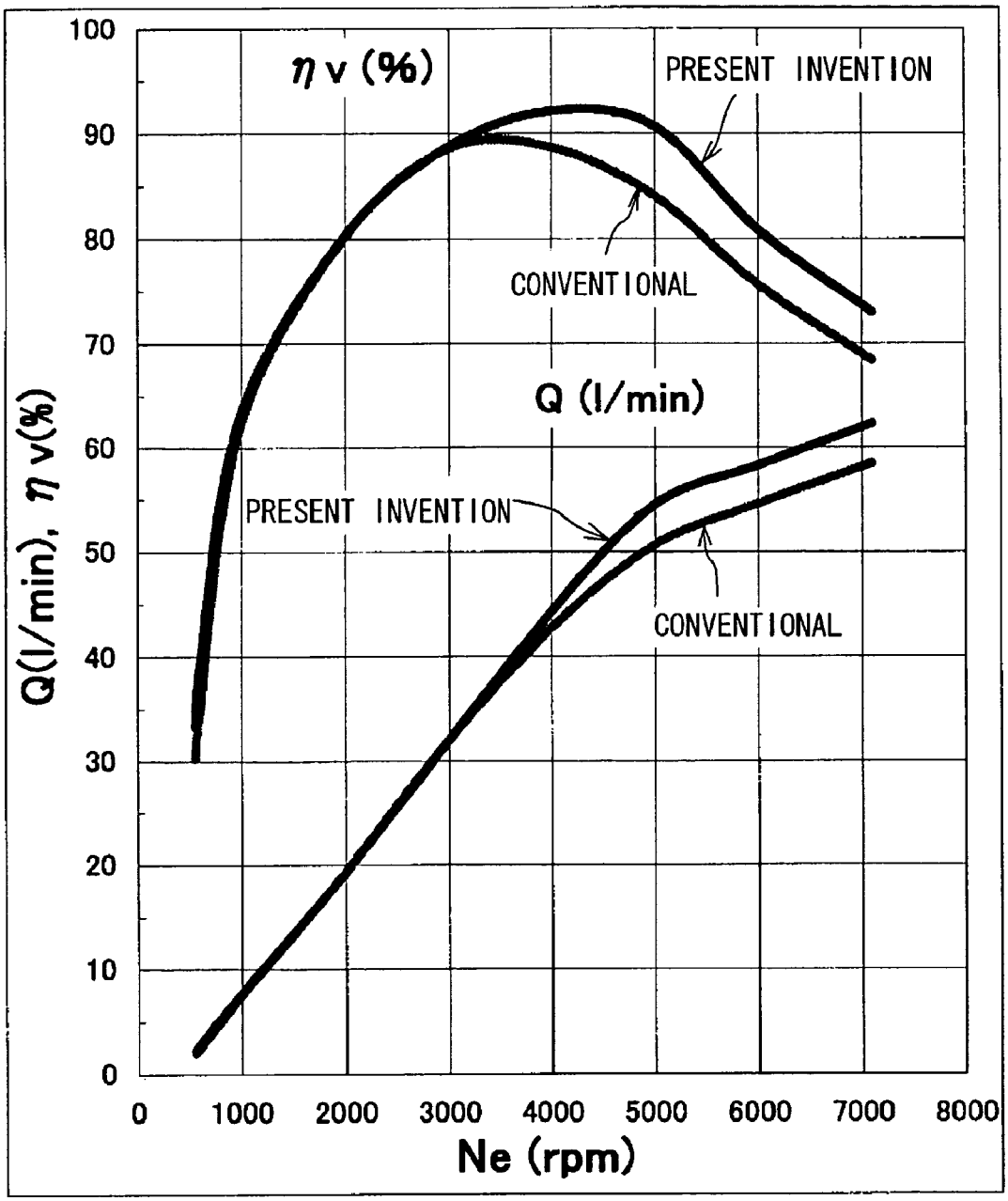
FIG. 8 is a graph which shows the characteristics of the present invention.

Next, the graph in FIG. 8 will be described. In the lower part of this graph, the pump flow rate Q (l/min) is plotted against the pump rpm (rpm). The lower graph line indicates a conventional pump, while the upper graph line indicates the pump of the present invention. It is seen from this graph that the pump of the present invention has an increased low rate compared to a conventional pump in the high-rpm region of 4000 rpm or greater. For example, at 6000 rpm in the high-rpm region, it is seen that the flow rate in a conventional pump is approximately 54 (l/min), while the flow rate of the pump of the present invention is increased to approximately 58 (l/min). Next, the volume efficiency θv (%) of the pump is shown in the upper part of the graph. The percentage of (pump discharge amount/theoretical discharge amount) relative to the pump rpm Ne (rpm) is shown. The value of the pump discharge amount relative to the theoretical discharge amount is shown at respective pump rpm values (rpm) on the horizontal axis of the graph. It is seen that the present invention has a higher volume efficiency than conventional pumps. Specifically, it is seen from this graph that the pump efficiency is improved.

As a second type of the non-contact regions K, recessed parts 6*c* are formed so that these recessed parts are recessed toward the inside of the tooth shapes 6*a* in at least one of the non-contact regions K, K formed in both side surfaces of the tooth shapes 6*a* in the lateral direction. The non-contact regions K of the first type were non-contact regions that were formed so that the external shape silhouette was formed slightly further to the inside than the external shape line of the tooth shapes of the outer rotor constituting the tooth shapes 6*a*. On the other hand, the non-contact regions K of the second type are non-contact regions in which recessed parts 6*c* are formed so that these recessed parts extend to a much greater inside depth than the external shape line of the outer rotor, thus creating a much larger gap between non-contact regions K of the tooth shapes 6*a* and the tooth shapes 5*a* of the inner rotor 5.

Figure 9:
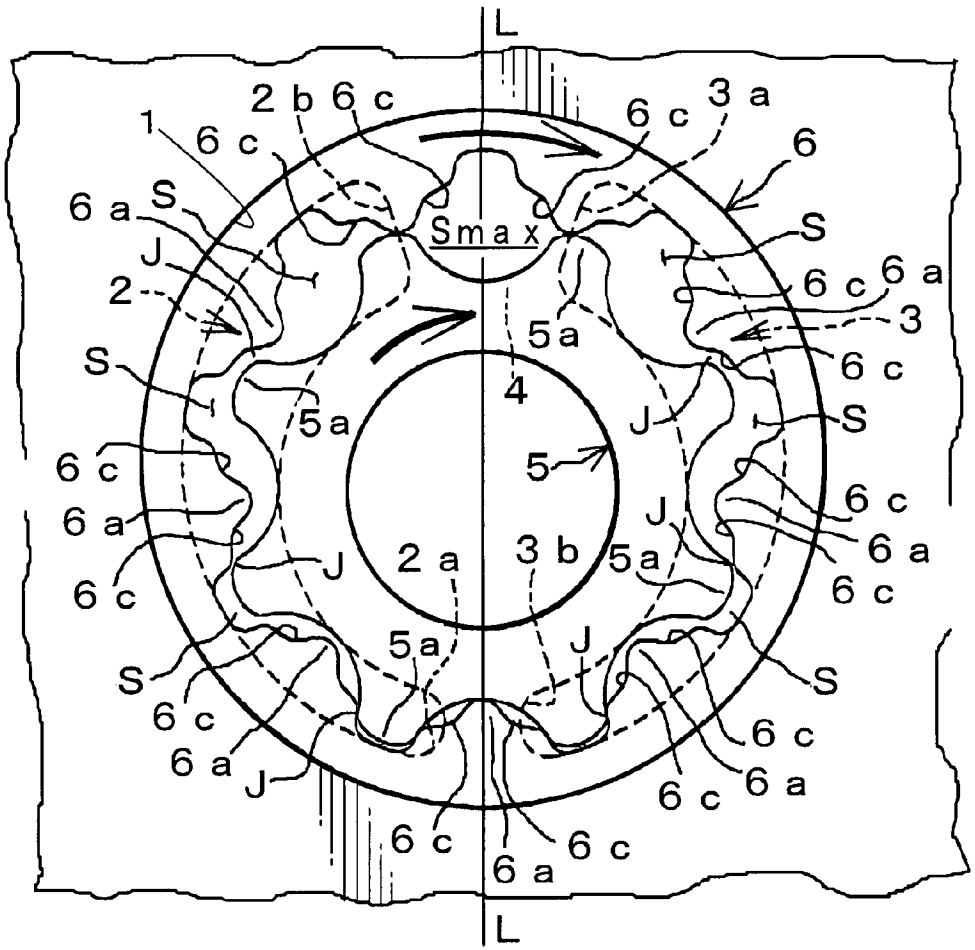
FIG. 9 is a front view showing a case in which an outer rotor in which non-contact regions of a second type are formed is provided in the first embodiment.
Figure 10B:
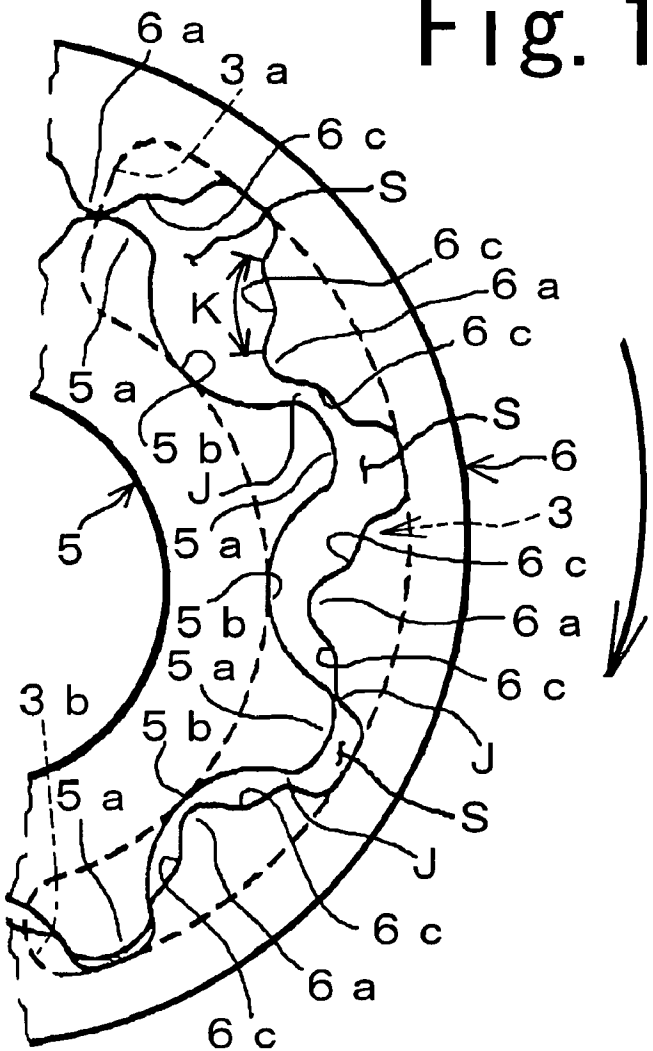
FIG. 10B is an enlarged view of a state in which the plurality of inter-tooth spaces on the discharge port side in FIG. 9 communicate with each other.
Figure 10A:
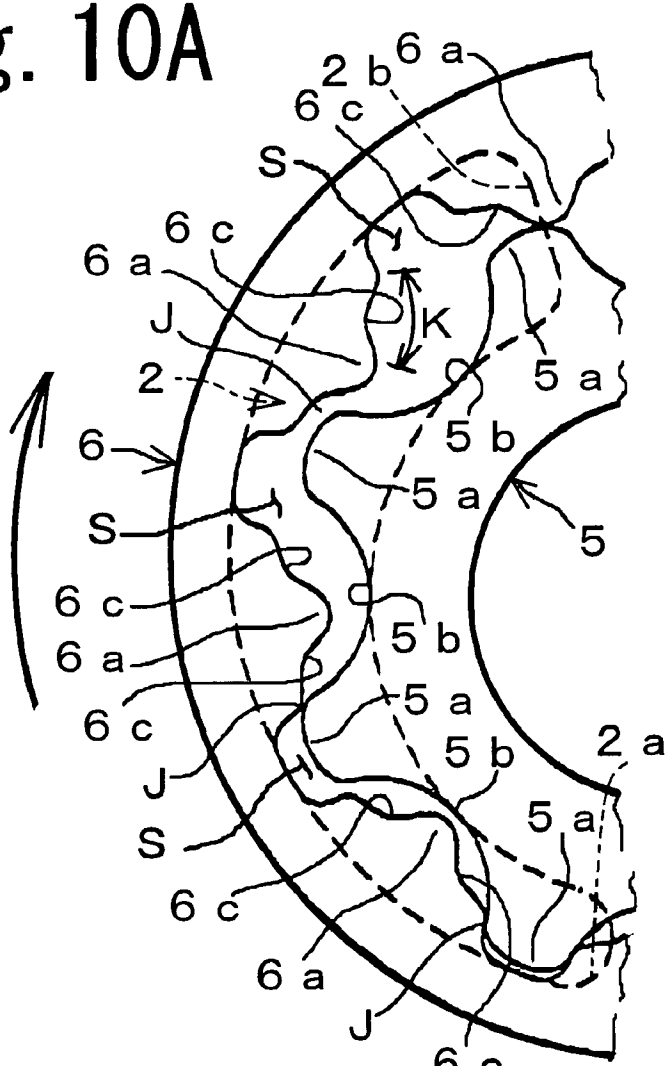
FIG. 10A is an enlarged view of a state in which the plurality of inter-tooth spaces on the intake port side in FIG. 9 communicate with each other.
Figure 11:
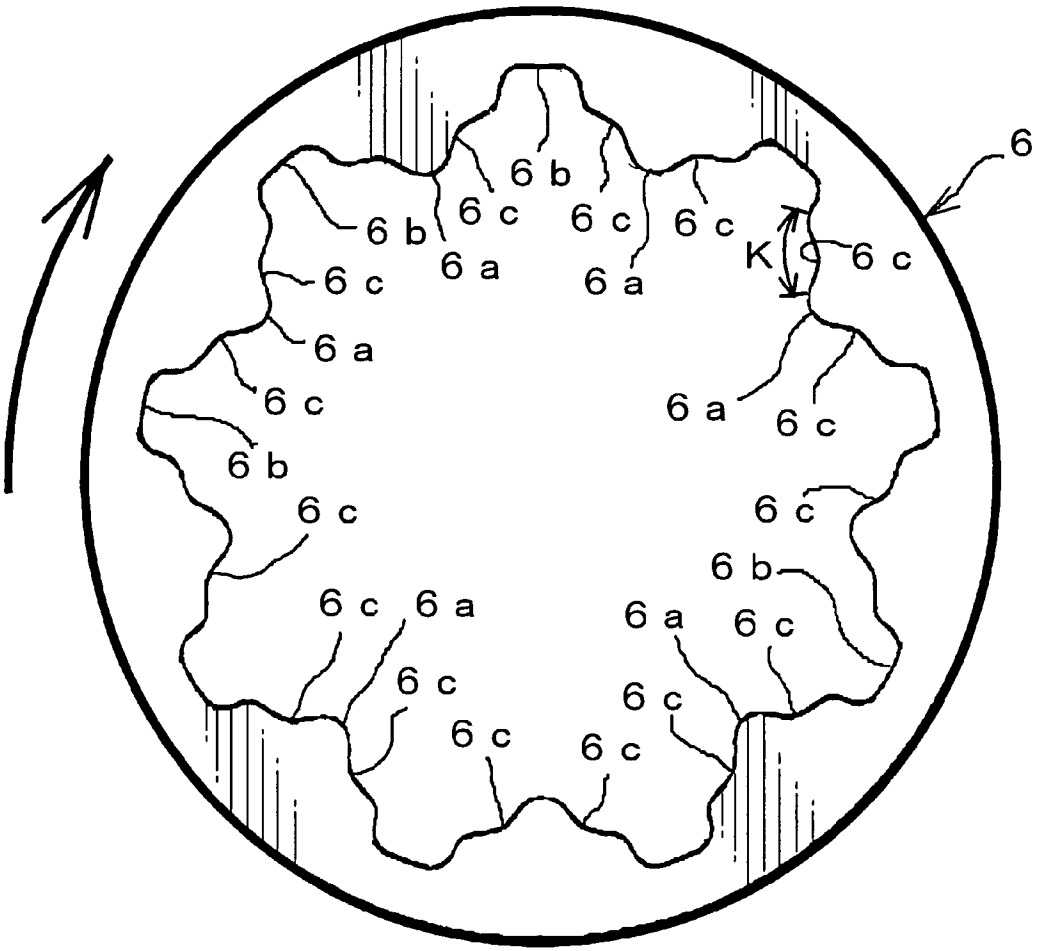
FIG. 11 is a front view of an outer rotor which has non-contact regions of a second type.
Figure 12:
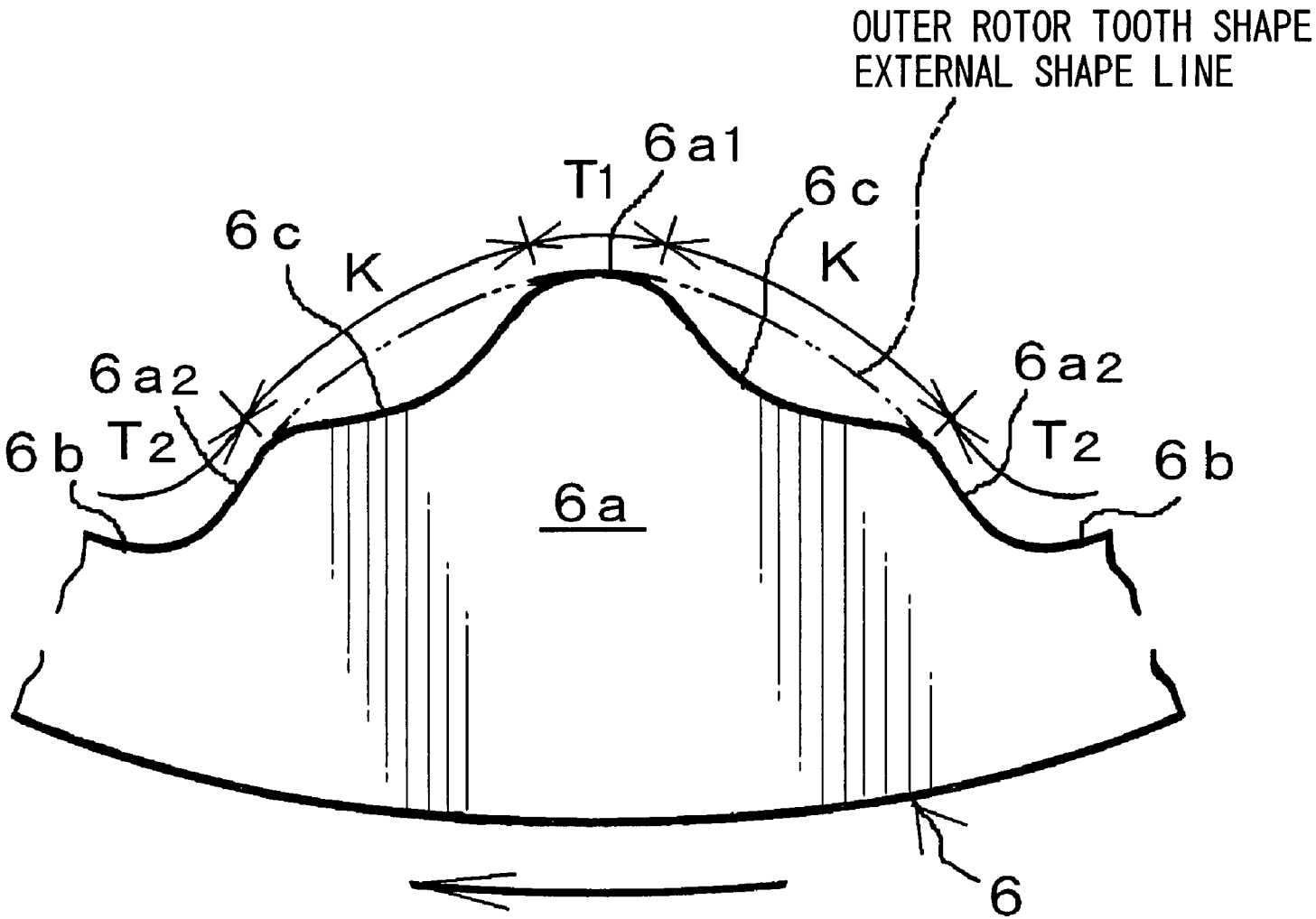
FIG. 12 is an enlarged front view of the tooth shape of this outer rotor which has non-contact regions of a second type.
Figure 13:
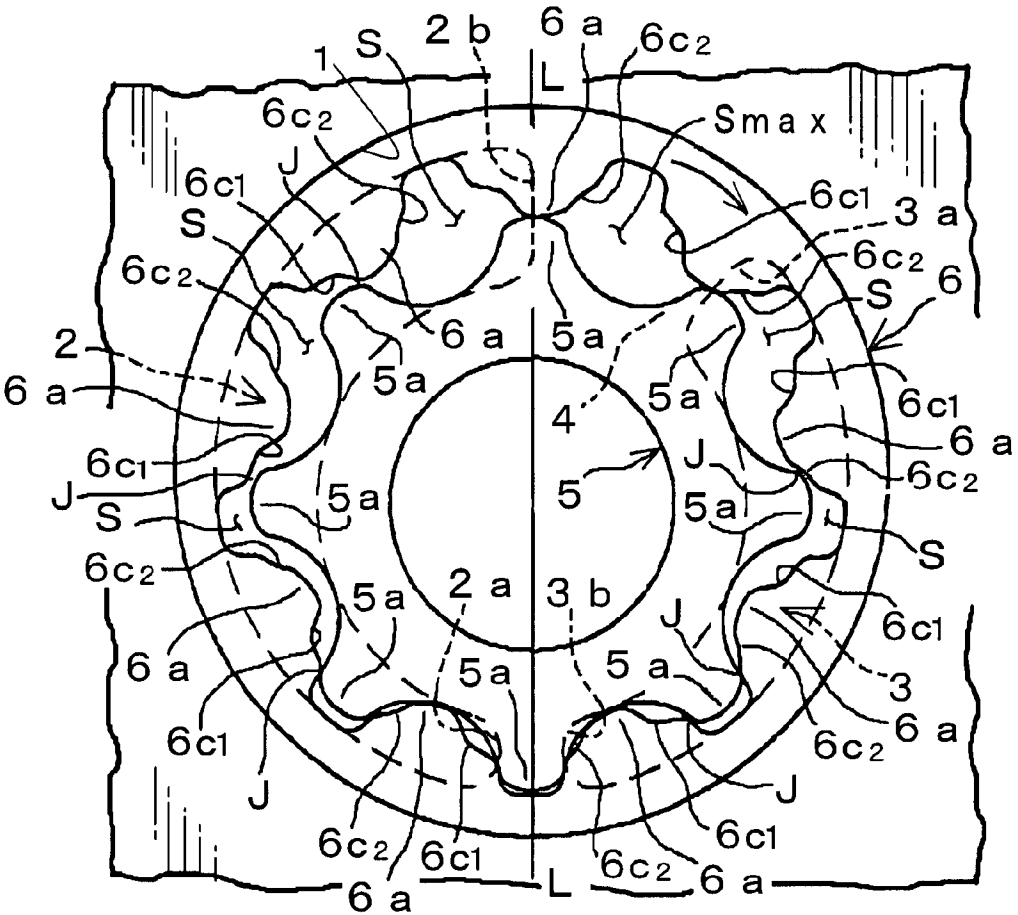
FIG. 13 is a front view showing a case in which an outer rotor in which non-contact regions of a third type are formed is provided in the second embodiment.
Figure 14B:
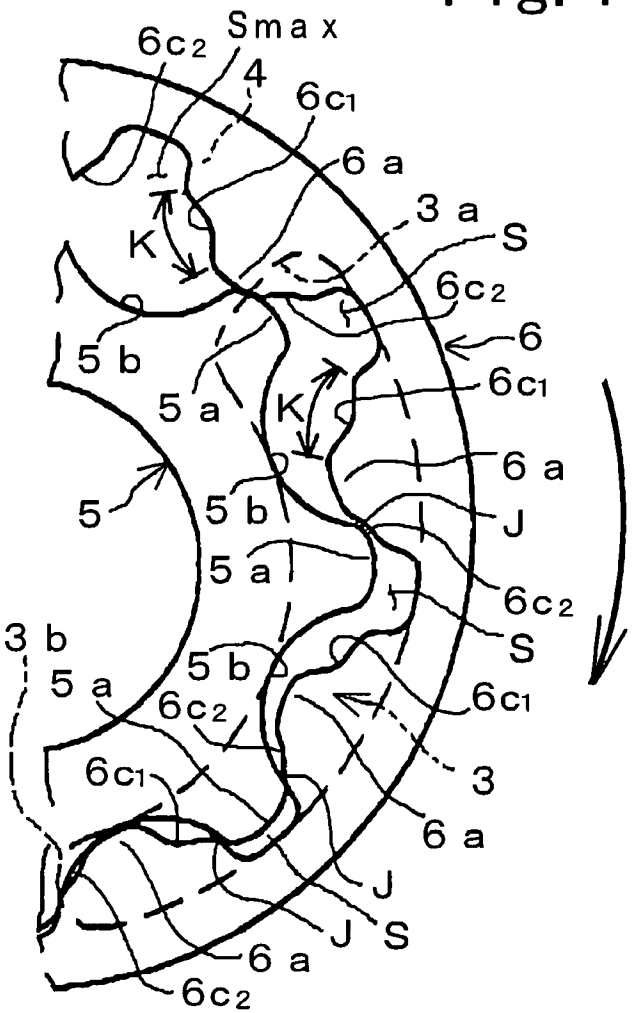
FIG. 14B is an enlarged view of a state in which the plurality of inter-tooth spaces on the discharge port side in FIG. 13 communicate with each other.
Figure 14A:
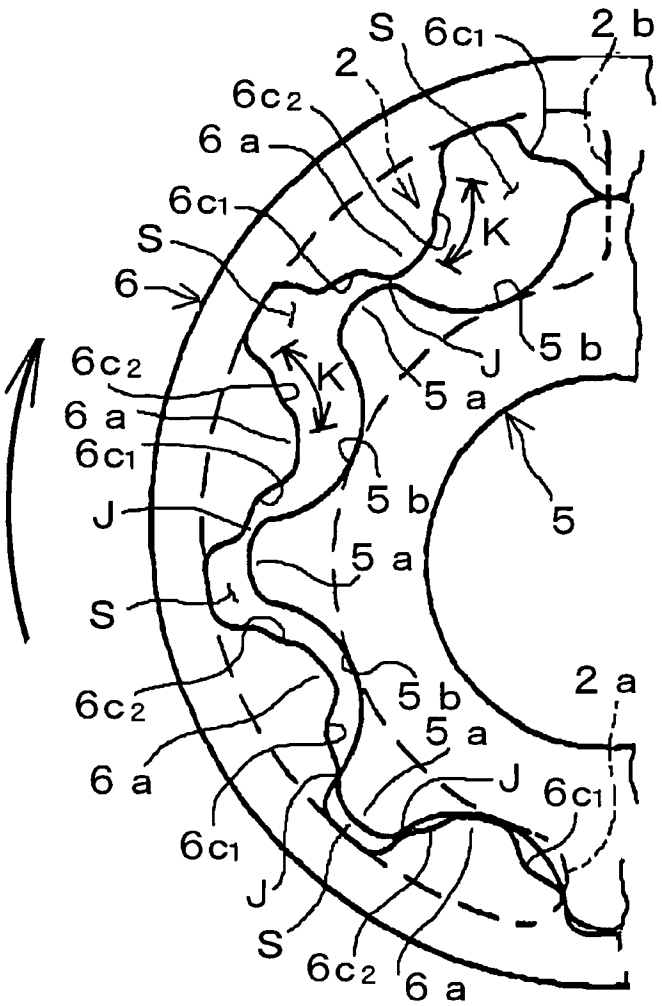
FIG. 14A is an enlarged view of a state in which the plurality of inter-tooth spaces on the intake port side in FIG. 13 communicate with each other.

As is shown in FIGS. 9 through 12, the recessed parts 6*c* are formed so that these recessed parts are recessed toward the insides of the tooth shapes 6*a*, and both of the recessed parts 6*c* formed in both side surfaces of the tooth shapes 6*a* have substantially the same size and shape, with both of these recessed parts 6*c* showing symmetry with respect to the center of the tooth shapes 6*a*. In regard to the concrete shapes of these recessed parts 6*c*, the recessed parts 6*c* are formed in the shape of a flattened circular arc toward the insides of the tooth shapes 6*a*. As is shown in FIGS. 9 and 10, the shapes of these recessed parts 6*c* are set so that the tooth shapes 5*a* of the inner rotor 5 can pass through while maintaining a substantially fixed gap when the inner rotor 5 and outer rotor 6 perform a rotational motion as a result of the driving of the pump. As is shown in FIGS. 11 and 12, a flattened circular arc is ideal as a shape that allows such an operation. Furthermore, even in the initial state in which large inter-tooth spaces S created by the tooth shapes 5*a* of the inner rotor 5 and the tooth shapes 6*a* of the outer rotor 6 have not yet been formed in the leading edge part 2*a* of the intake port 2, the recessed parts 6*c* form small spaces that allow the inflow of the fluid, and thus act to improve the pump efficiency.

Figure 23:
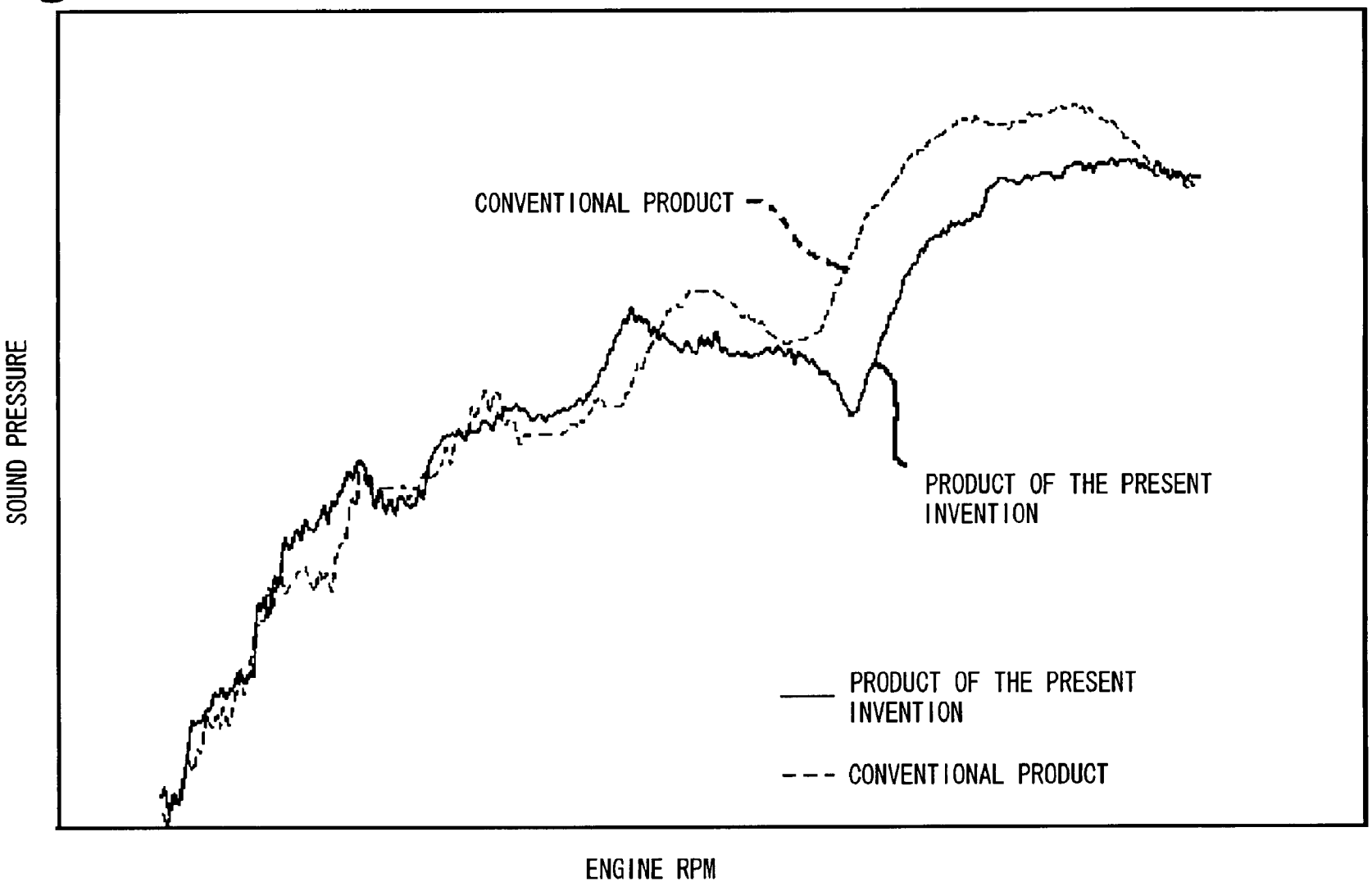
FIG. 23 is a graph which shows the relationship between the engine rpm and sound pressure.
Figure 24:
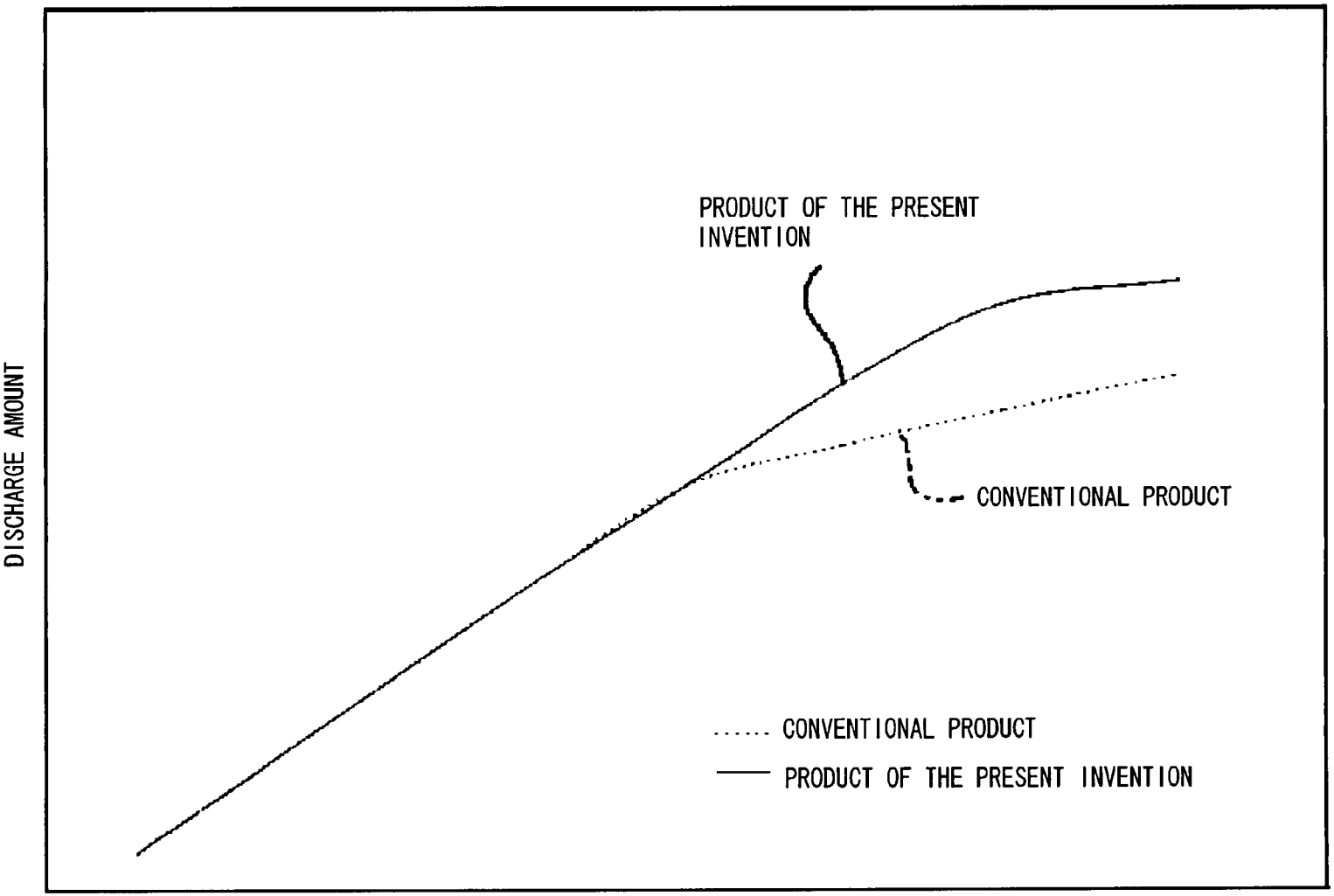
FIG. 24 is a graph which shows the relationship between the engine rpm and the discharge amount.

As a result of the recessed parts 6*c*, 6*c* being formed in both side surfaces of the tooth shapes 6 in the lateral direction, the communicating parts J, J, . . . in the intake port 2 and discharge port 3 are widened, so that the fluid can be caused to move much more smoothly through the inter-tooth spaces S, S, . . . in the pump driving in which the inner rotor 5 and outer rotor 6 rotate. Accordingly, the pressure fluctuations in the inter-tooth spaces S, S, . . . can be reduced to an extremely low level (see FIG. 24 (graph showing the relationship between engine rpm and discharge amount)). Furthermore, the noise that accompanies the driving of the pump can be reduced (see FIG. 23 (graph showing the relationship between engine rpm and sound pressure)).

Figure 15:
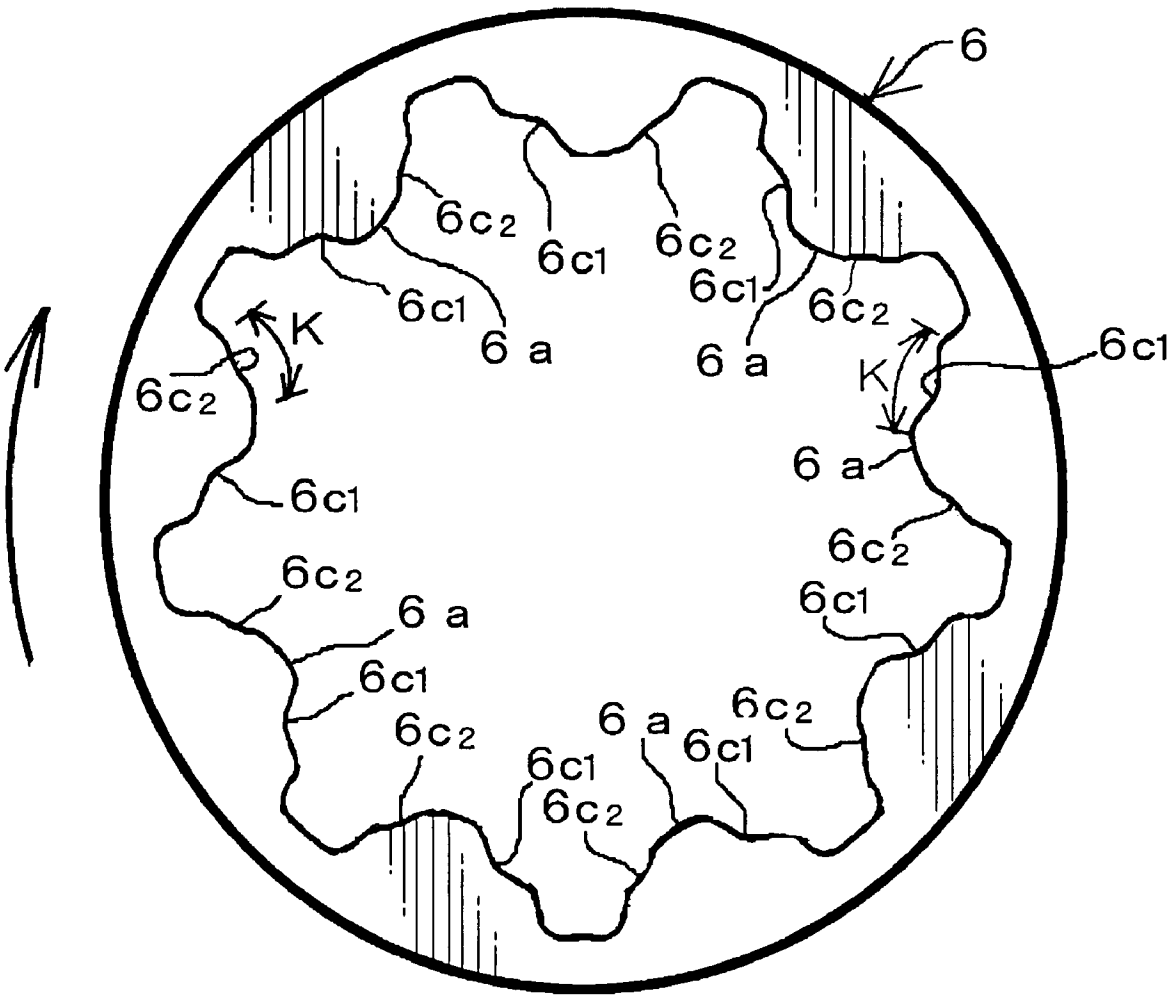
FIG. 15 is a front view of an outer rotor in which non-contact regions of a third type are formed.
Figure 16:
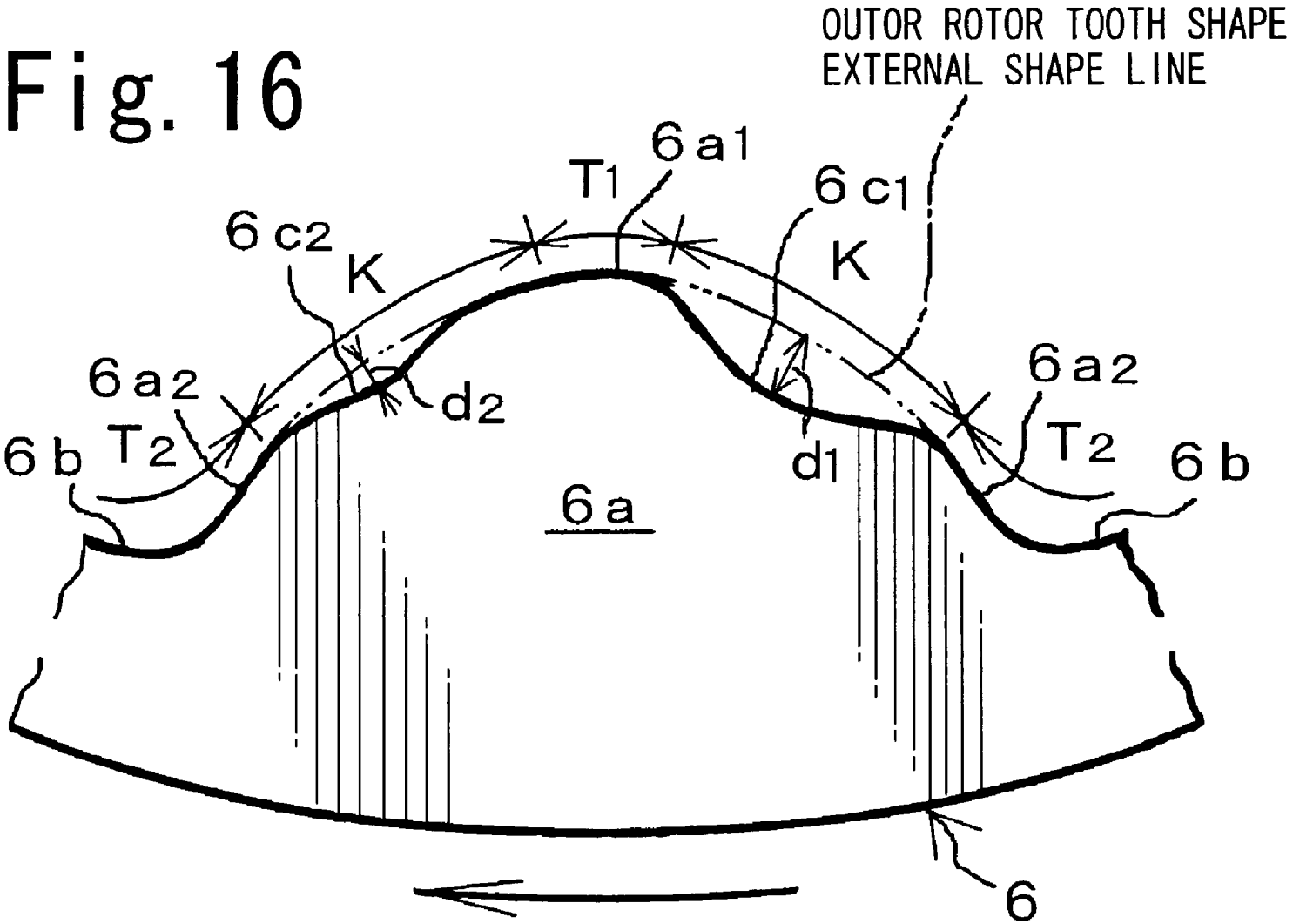
FIG. 16 is an enlarged front view of the tooth shape of this outer rotor in which non-contact regions of a third type are formed.

Next, as a third type of non-contact regions K, an embodiment also exists in which both recessed parts 6*c*, 6*c* formed in both of the side surfaces of the tooth shapes 6*a* in the lateral direction are formed asymmetrically so that these recessed parts have different sizes as shown in FIGS. 13 through 17. Here, the recessed parts 6*c* that are formed so that these parts are positioned on the rear sides of the tooth shapes 6*a* in the direction of rotation with respect to the direction of rotation of the outer rotor 6 during the operation of the pump are designated as the rear side recessed parts $\mathbf{6}c_1$, and the recessed parts 6*c* that are formed so that these parts are positioned on the front sides of the tooth shapes 6*a* in the direction of rotation are designated as the front side recessed parts $\mathbf{6}c_2$. These rear side recessed parts $\mathbf{6}c_1$ and front side recessed parts $\mathbf{6}c_2$ use the direction of rotation during the pump driving of the outer rotor 6 as a reference, and are thus determined by the direction of rotation of the outer rotor 6. Furthermore, the front size recessed parts $\mathbf{6}c_2$ are formed with a smaller size than the rear side recessed parts $\mathbf{6}c_1$. As is shown in FIGS. 15 and 16, the difference in size between the asymmetrical front side recessed parts $\mathbf{6}c_2$ and rear side recessed parts $6c_1$ that are formed in both side surfaces of the tooth shapes 6*a* in the lateral direction is mainly the difference in depth between the recessed parts 6*c*.

Specifically, the depth $d_1$ of the rear side recessed parts $6c_1$ is deeper than the depth $d_2$ of the front side recessed parts $6c_2$, i.e., depth $d_1$>depth $d_2$, as shown in FIG. 16. In this case, the depth $d_2$ of the front side recessed parts $6c_2$ may be formed as a shallow depth, and the depth $d_1$ of the rear side recessed parts $6c_1$ may be formed as the ordinary depth, or the depth $d_2$ of the front side recessed parts $6c_2$ may be formed as the ordinary depth, and the depth $d_1$ of the rear side recessed parts $6c_1$ may be formed as a greater depth. Furthermore, the formation ranges of the front side recessed parts $6c_2$ and rear side recessed parts $6c_1$ in the lateral direction of the tooth shapes 6*a* may also vary along with the respective depths of these recessed parts; for example, the formation range in the lateral direction of the front side recessed parts $6c_2$ with a shallow depth of $d_2$ is narrow, and the formation range in the lateral direction of the rear side recessed parts $6c_1$ with a large depth of $d_1$ is wide.

Figure 17A:
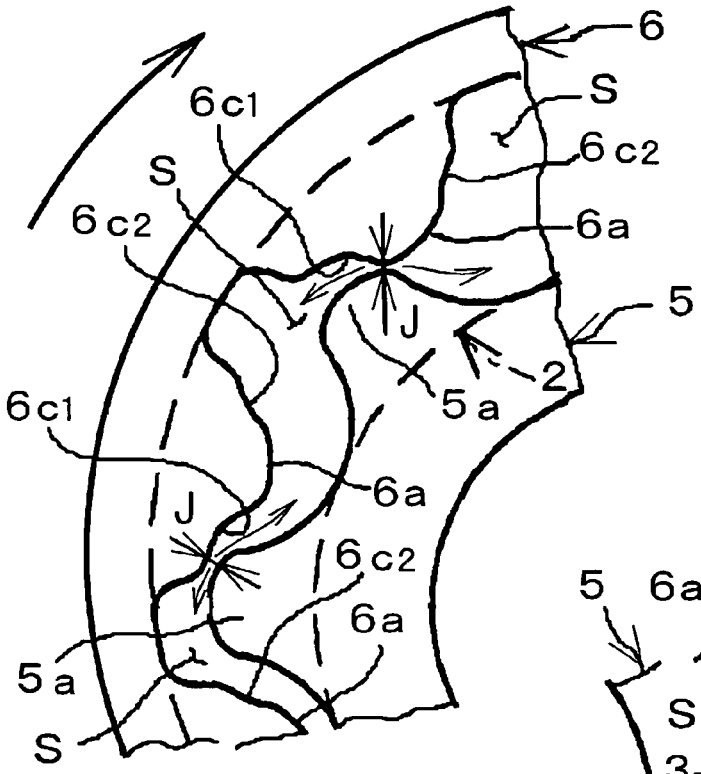
FIG. 17A is an enlarged view of the essential parts of an inner rotor and outer rotor in which non-contact regions of a third type are formed on the intake port side.
Figure 17B:
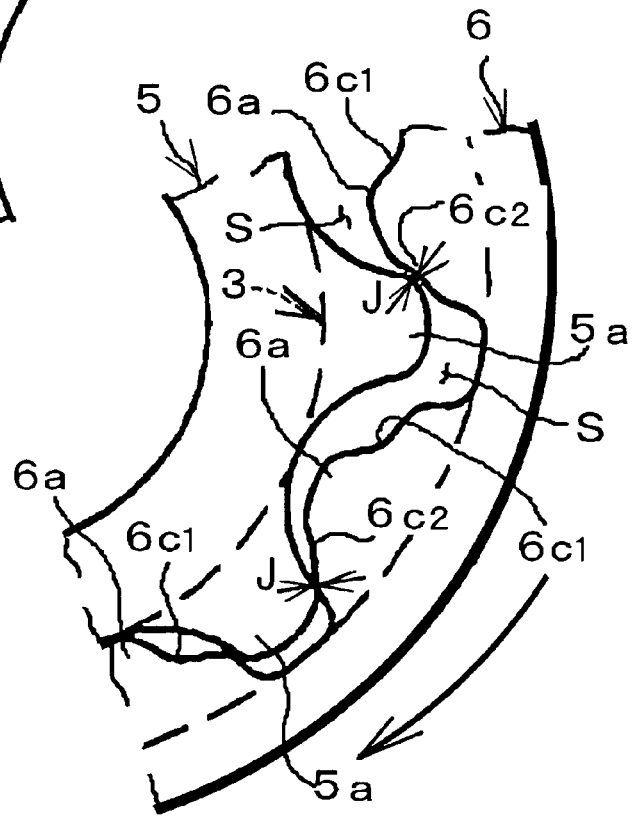
FIG. 17B is an enlarged view of the essential parts of an inner rotor and outer rotor in which non-contact regions of a third type are formed on the discharge port side.

Furthermore, if such a construction is used, then in cases where pump driving is performed so that the inner rotor 5 and outer rotor 6 rotate in the clockwise direction, the width of the communicating parts J that are formed between the rear side recessed parts $6c_1$ (formed with a large depth of $d_1$) and the tooth shapes 5*a* of the inner rotor 5 on the side of the intake port 2 is broadened as shown in FIG. 17A, so that the amount of fluid that flows through the inter-tooth spaces S, S, . . . is greatly increased. Accordingly, the flow of the fluid through the inter-tooth spaces S, S, . . . can be made more active. Furthermore, on the side of the discharge port 3, as is shown in FIG. 17B, the width of the communicating parts J formed between the front side recessed parts $6c_2$ (which are formed with a shallow depth of $d_2$) and the tooth shapes 5*a* of the inner rotor 5 is narrowed so that the amount of fluid that flows through the inter-tooth spaces S, S, . . . is extremely small. Consequently, it is possible to make it difficult for the fluid to flow through the inter-tooth spaces S, S . . . Specifically, this pump is devised so that a difference is created between the amount of communication between the inter-tooth spaces S, S, . . . on the side of the intake port 2 and the inter-tooth spaces S, S, . . . on the side of the discharge port 3 (see FIGS. 10(A) and 10 (B)).

As a result, the flow rate can be increased, and noise can be reduced. In this type in which the shapes of the front side recessed parts $6c_2$ and rear side recessed parts $6c_1$ are made asymmetrical, the construction of the rotor chamber 1 is applied to a chamber in which the formation positions of the trailing edge part 2*b* of the intake port 2 and the leading edge part 3*a* of the discharge port formed inside the rotor chamber 1 are centered on the left-right symmetry line L of the rotor chamber 1, with the trailing edge part 2*b* of the intake port 2 being formed in the vicinity of the left-right symmetry line L, and the leading edge part 3*a* of the discharge port 3 being formed in a position that is separated from the left-right symmetry line L, as is shown in FIG. 5 and FIG. 7B.

Figure 18:
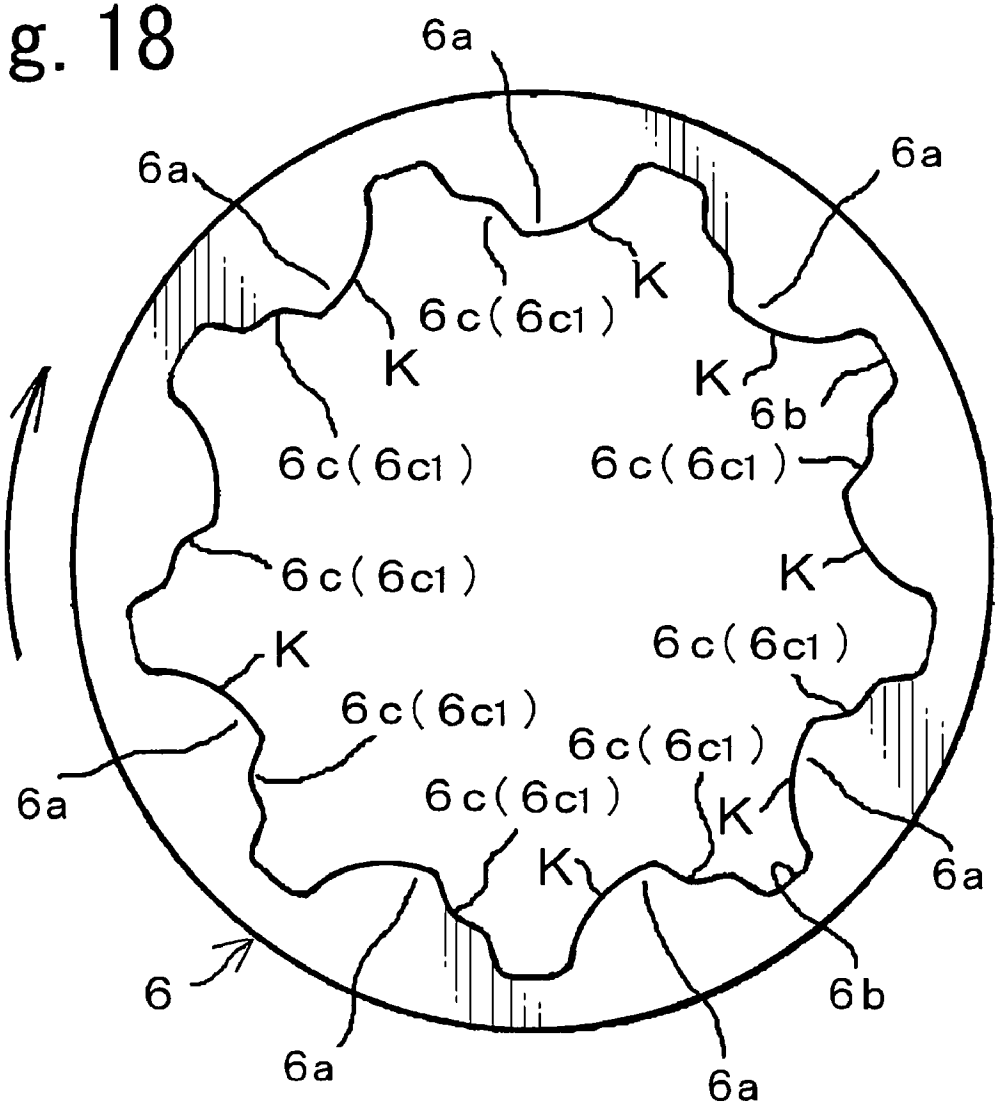
FIG. 18 is a front view of an outer rotor in which non-contact regions of a fourth type are formed.
Figure 19:
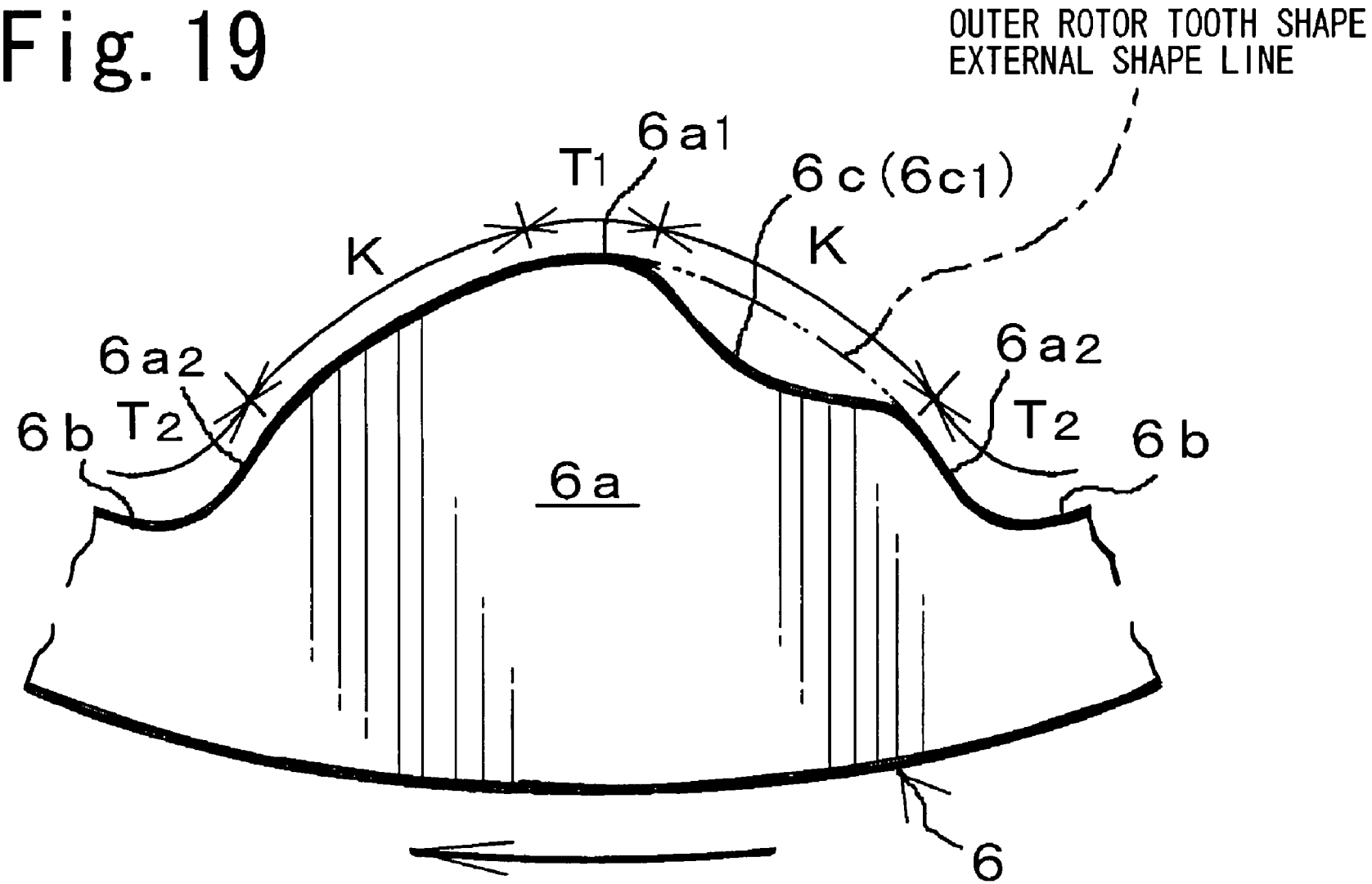
FIG. 19 is an enlarged front view of the tooth shape of this outer rotor in which non-contact regions of a fourth type are formed.
Figure 20A:
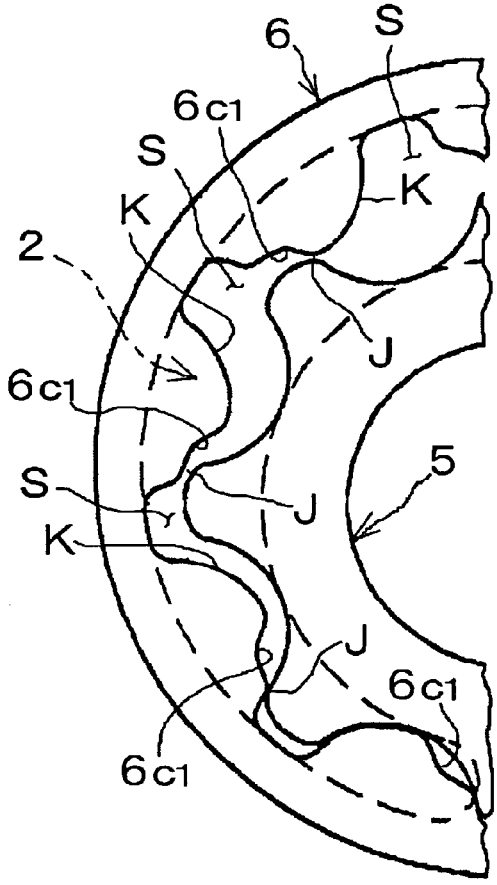
FIG. 20A is an enlarged view of a state in which the plurality of inter-tooth spaces formed by the inner rotor and outer rotor in which non-contact regions of a fourth type are formed on the intake port side communicate with each other.
Figure 20B:
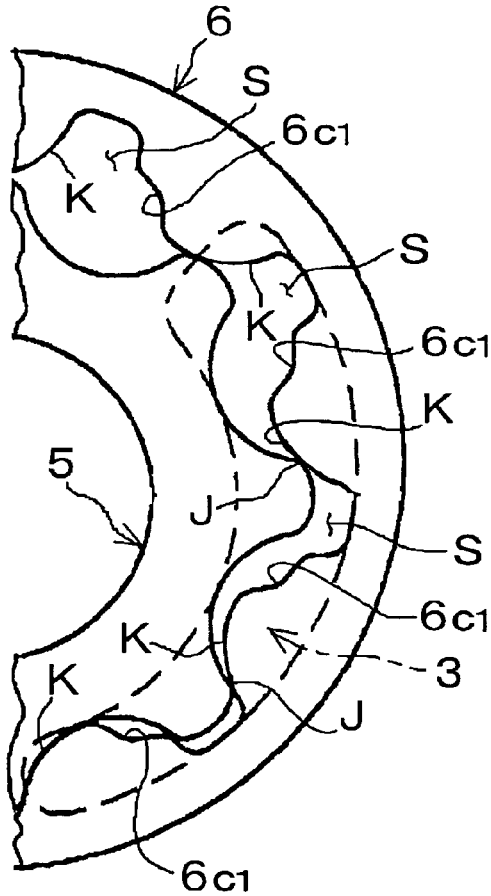
FIG. 20B is an enlarged view of a state in which the plurality of inter-tooth spaces formed by the inner rotor and outer rotor in which non-contact regions of a fourth type are formed on the discharge port side communicate with each other.
Figure 21:
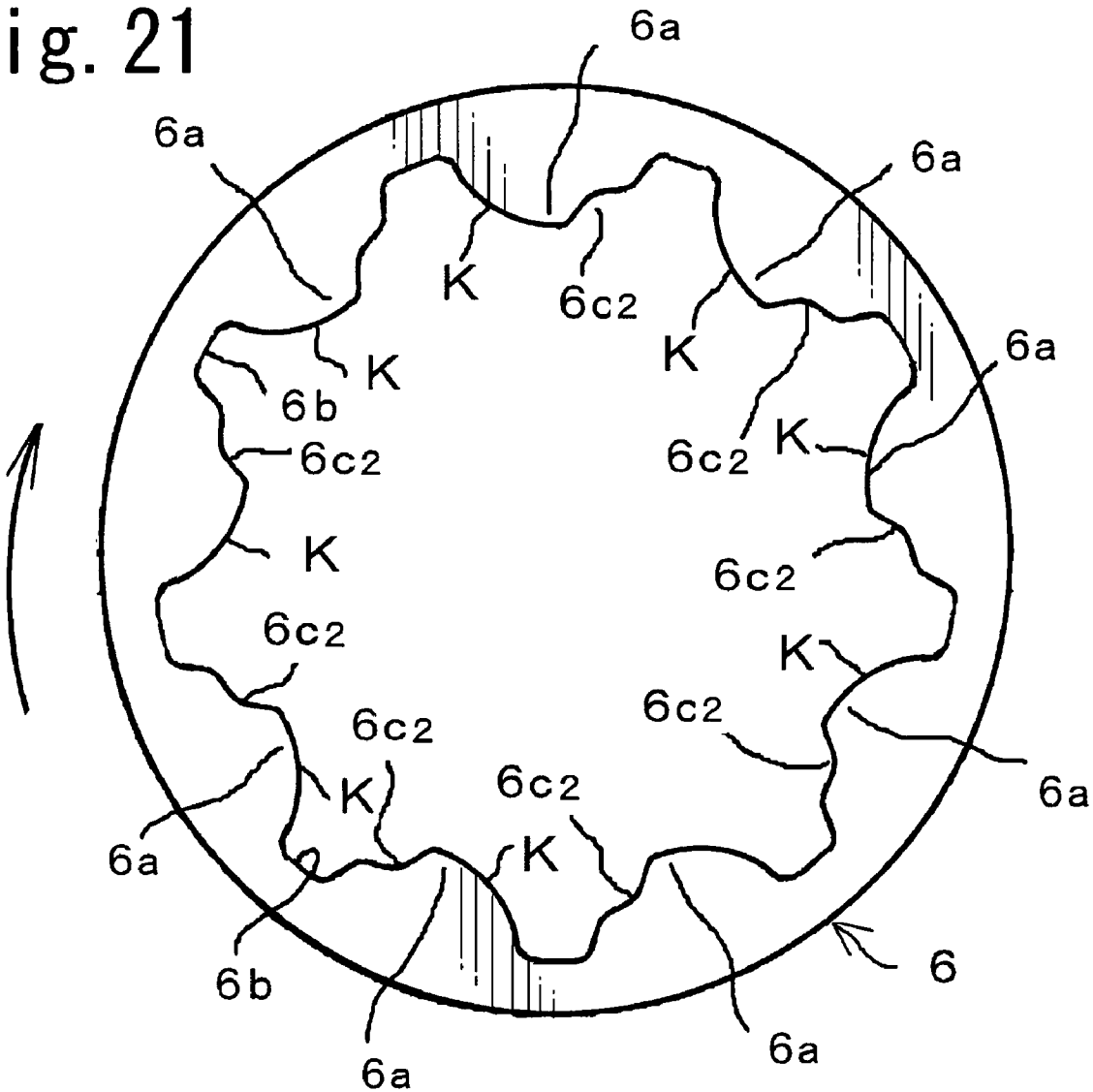
FIG. 21 is a front view of an outer rotor in which regions constituting a modification of the non-contact regions of the fourth type are formed.
Figure 22:
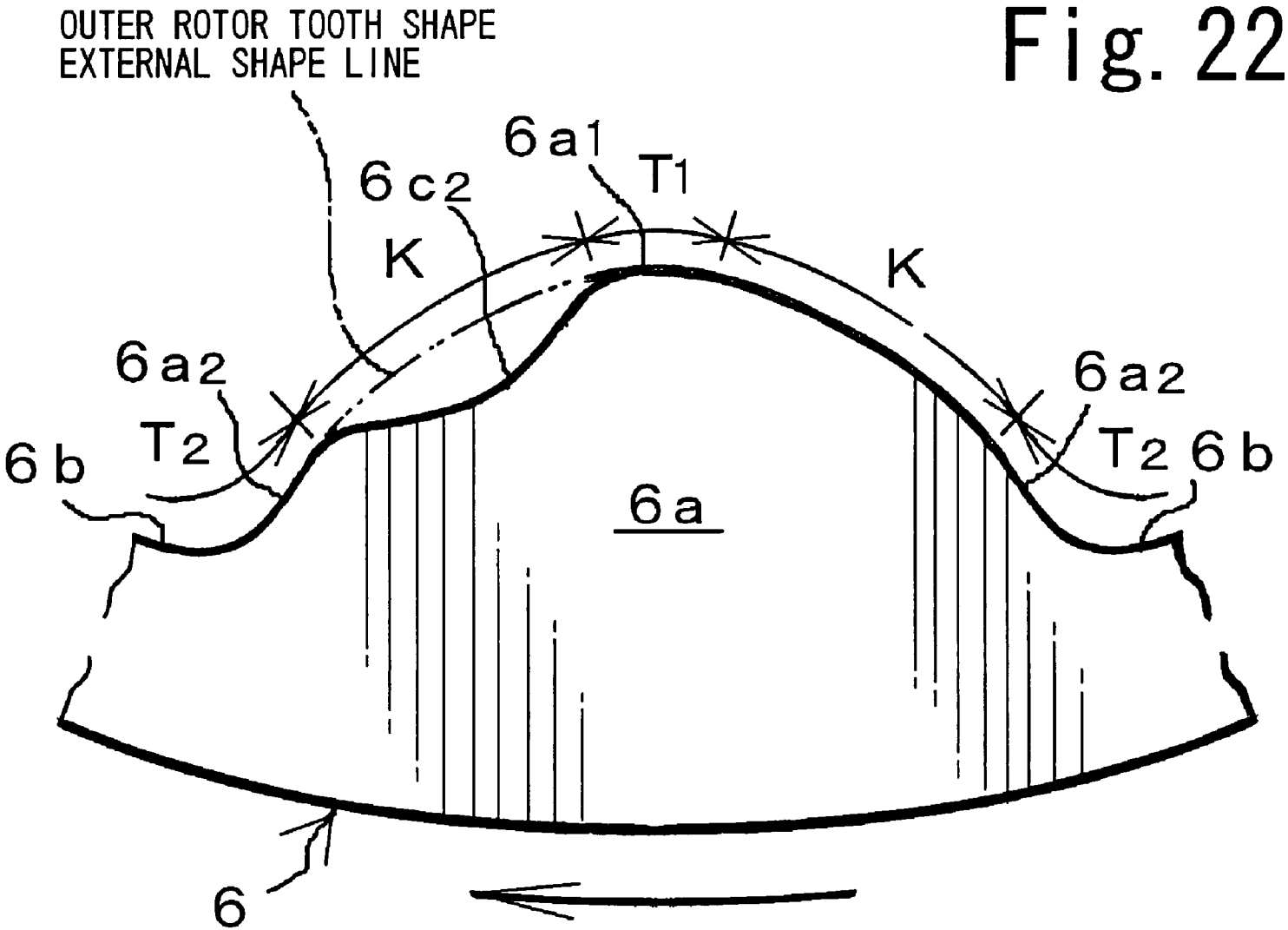
FIG. 22 is an enlarged front view of the tooth shape of this outer rotor in which regions constituting a modification of the non-contact regions of the fourth type are formed.

Furthermore, in a fourth type, as is shown in FIGS. 18 through 20, the recessed parts 6*c* are formed in only one side of the non-contact regions K, K of the tooth shapes 6*a*. Specifically, one side of each tooth shape 6*a* in the lateral direction is formed with an ordinary non-contact region K, while the other side is formed with a non-contact region K that is created by a recessed part 6*c*. Furthermore, the recessed parts 6*c* may also be formed only in the rear sides of the tooth shapes 6*a* with respect to the direction of rotation. Moreover, as a modification of this fourth type as shown in FIGS. 21 and 22, the recessed parts 6*c* may also be formed only in the front sides of the tooth shapes 6*a* with respect to the direction of rotation.

What is claimed is:

1. A trochoidal oil pump comprising:

a rotor chamber which has an intake port and a discharge port;

an outer rotor; and an inner rotor, wherein a tooth shape of the inner rotor is formed according to a trochoidal curve, a top part contact region and a root part contact region, which make contact in an engagement with the tooth shape of the inner rotor, are formed in a tooth top part and a tooth root part of the tooth shape of the outer rotor, a non-contact region, which is always in a state of non-contact region, which is always in a state of non-contact with the tooth shape of the inner rotor, is formed on a side edge of the tooth shape between the top part contact region and root part contact region of the tooth shape, and a region equivalent to the non-contact region is not formed on a side of the inner rotor side, wherein a plurality of inter-tooth spaces formed by the tooth shapes of the inner rotor and outer rotor comprise a maximum sealed space that is positioned in a region of a partition part between the intake port and discharge port, a plurality of inter-tooth spaces within a region of intake port, and a plurality of inter-tooth spaces within a region of the discharge port, and the plurality of inter-tooth spaces in said intake port and discharge port respectively communicate with each other via communicating parts formed by the non-contact region in the outer rotor.

2. The trochoidal oil pump according to claim 1, wherein the number of teeth of said inner rotor is set at 6 or greater, and the maximum sealed space formed by said outer rotor and inner rotor is formed in the partition part between the intake port and the discharge port.

3. The trochoidal oil pump according to claim 1, wherein the shape of the outer peripheral edge in the non-contact region of said tooth shape is a curved shape.

4. The trochoidal oil pump according to claim 1, wherein formation positions of a trailing edge part of the intake port and a leading edge part of the discharge port inside the rotor chamber are located with respect to a left-right symmetry line of said rotor chamber so that the trailing edge part of said intake port is formed in the vicinity of said left-right symmetry line, and so that the leading edge part of said discharge port is formed in a position that is separated from said left-right symmetry line, and the maximum sealed space that is formed by said outer rotor and inner rotor is formed in the partition part between the trailing edge part of the intake port and the leading edge part of the discharge port.

5. The trochoidal oil pump according to claim 1, wherein a recessed part is formed in at least one of the non-contact regions formed on both side surfaces of said tooth shape in the lateral direction, so that this recessed part is recessed toward the inside of said tooth shape.

6. The trochoidal oil pump according to claim 5, wherein said recessed part is formed only in the rear side of said tooth shape with respect to the direction of rotation.

7. The trochoidal oil pump according to claim 5, wherein said recessed part is formed in both side surfaces of said tooth shape in the lateral direction.

8. The trochoidal oil pump according to claim 5, wherein said recessed part is formed in a flattened arc shape facing the inside of the tooth shape.

9. The trochoidal oil pump according to claim 7, wherein both recessed parts formed in both side surfaces of said tooth shape in the lateral direction have a symmetrical shape with respect to the center of said tooth shape.

10. The trochoidal oil pump according to claim 7, wherein both recessed parts formed in both side surfaces of said tooth shape in the lateral direction have a asymmetrical shape with respect to the center of said tooth shape, and a recessed part on the rear side with respect to the direction of rotation is formed so that this recessed part is larger than the recessed part on the front side with respect to the direction of rotation in both side surfaces of said tooth shape in the lateral direction.

11. The trochoidal oil pump according to claim 2, wherein the shape of the outer peripheral edge in the non-contact region of said tooth shape comprises a curved shape.

12. The trochoidal oil pump according to claim 2, wherein formation positions of a trailing edge part of the intake port and a leading edge part of the discharge port inside the rotor chamber are located with respect to a left-right symmetry line of said rotor chamber so that the trailing edge part of said intake port is formed in the vicinity of said left-right symmetry line, and so that the leading edge part of said discharge port is formed in a position that is separated from said left-right symmetry line, and the maximum sealed space that is formed by said outer rotor and inner rotor is formed in the partition part between the trailing edge part of the intake port and the leading edge part of the discharge port.

13. The trochoidal oil pump according to claim 3, wherein formation positions of a trailing edge part of the intake port and a leading edge part of the discharge port inside the rotor chamber are located with respect to a left-right symmetry line of said rotor chamber so that the trailing edge part of said intake port is formed in the vicinity of said left-right symmetry line, and so that the leading edge part of said discharge port is formed in a position that is separated from said left-right symmetry line, and the maximum sealed space that is formed by said outer rotor and inner rotor is formed in the partition part between the trailing edge part of the intake port and the leading edge part of the discharge port.

14. The trochoidal oil pump according to claim 2, wherein a recessed part is formed in at least one of the non-contact regions formed on both side surfaces of said tooth shape in the lateral direction, so that this recessed part is recessed toward the inside of said tooth shape.

15. The trochoidal oil pump according to claim 3, wherein a recessed part is formed in at least one of the non-contact regions formed on both side surfaces of said tooth shape in the lateral direction, so that this recessed part is recessed toward the inside of said tooth shape.

16. The trochoidal oil pump according to claim 4, wherein a recessed part is formed in at least one of the non-contact regions formed on both side surfaces of said tooth shape in the lateral direction, so that this recessed part is recessed toward the inside of said tooth shape.

17. The trochoidal oil pump according to claim 1, wherein said plurality of inter-tooth spaces are disposed in a state of communication in formation regions of the intake port and the discharge port.

* * * * *